US010822551B2

(12) United States Patent
Noureldin et al.

(10) Patent No.: US 10,822,551 B2
(45) Date of Patent: Nov. 3, 2020

(54) REFINERY PRE-HEAT TRAIN SYSTEMS AND METHODS

(71) Applicant: Saudi Arabian Oil Company, Dhahran (SA)

(72) Inventors: Mahmoud Bahy Mahmoud Noureldin, Dhahran (SA); Zeeshan Farooq, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/654,685

(22) Filed: Oct. 16, 2019

(65) Prior Publication Data

US 2020/0048563 A1 Feb. 13, 2020

Related U.S. Application Data

(63) Continuation of application No. 15/444,991, filed on Feb. 28, 2017, now Pat. No. 10,494,576.

(Continued)

(51) Int. Cl.

*C10G 31/08* (2006.01)
*C10G 31/06* (2006.01)

(Continued)

(52) U.S. Cl.

CPC ..... *C10G 31/08* (2013.01); *C10G 7/00* (2013.01); *C10G 7/12* (2013.01); *C10G 31/06* (2013.01);

(Continued)

(58) Field of Classification Search

CPC . C10G 31/08; C10G 7/12; C10G 7/00; C10G 31/06; C10G 2300/4006; F28D 2021/0059; F28F 27/00

See application file for complete search history.

(56) References Cited

U.S. PATENT DOCUMENTS 4,082,653 A * 4/1978 DeGraff ..... C10G 7/00 208/251 R
8,032,262 B2 10/2011 Noureldin (Continued)

OTHER PUBLICATIONS

Aseeri et al.; "Increase Crude Unit Capacity through Better Integration"; Hydrocarbon Processing; Aug. 2010; pp. 79-81, <http://gap-tech.com/wp-content/uploads/2017/02/CrudeUnitDeBottlenecking_Energy-Integration_HP-Aug-2010.pdf>.

(Continued)

*Primary Examiner* — Randy Boyer
*Assistant Examiner* — Juan C Valencia
(74) *Attorney, Agent, or Firm* — Fish & Richardson P.C.

(57) ABSTRACT

A crude oil refinery pre-heat train (PHT) includes a crude oil stream pipeline system that extends through the PHT and is configured to carry a stream of crude oil from an inlet of the PHT to a furnace of the PHT; heat exchangers positioned in the crude oil stream pipeline system; and a control system. The heat exchangers include a first set of heat exchangers positioned in the crude oil stream pipeline system between the inlet of the PHT and one or more de-salters of the PHT; a second set of heat exchangers positioned in the crude oil stream pipeline system between the one or more de-salters of the PHT and one or more pre-flash drums of the PHT; and a third set of heat exchangers positioned between the one or more pre-flash drums of the PHT and the furnace of the PHT.

30 Claims, 9 Drawing Sheets

Related U.S. Application Data

(60) Provisional application No. 62/334,095, filed on May 10, 2016.

(51) Int. Cl.

| | |
|---|---|
| ***C10G 7/12*** | (2006.01) |
| ***C10G 7/00*** | (2006.01) |
| ***F28F 27/00*** | (2006.01) |
| ***F28D 21/00*** | (2006.01) |

(52) U.S. Cl.

CPC ..... *C10G 2300/4006* (2013.01); *F28D 2021/0059* (2013.01); *F28F 27/00* (2013.01)

(56) References Cited

U.S. PATENT DOCUMENTS

| | | | |
|---|---|---|---|
| 8,116,918 | B2 | 2/2012 | Noureldin et al. |
| 8,116,920 | B2 | 2/2012 | Noureldin |
| 8,150,559 | B2 | 4/2012 | Noureldin |
| 8,150,560 | B2 | 4/2012 | Noureldin |
| 8,311,682 | B2 | 11/2012 | Noureldin et al. |
| 8,349,267 | B2 | 1/2013 | Cody et al. |
| 8,364,327 | B2 | 1/2013 | Noureldin et al. |
| 8,417,486 | B2 | 4/2013 | Noureldin |
| 9,321,972 | B2 | 4/2016 | Noureldin et al. |
| 9,360,910 | B2 | 6/2016 | Noureldin et al. |
| 9,378,313 | B2 | 6/2016 | Noureldin et al. |
| 9,442,470 | B2 | 9/2016 | Noureldin et al. |
| 2008/0015839 | A1 | 1/2008 | Noureldin et al. |
| 2010/0070258 | A1 | 3/2010 | Noureldin |
| 2010/0223198 | A1 | 9/2010 | Noureldin et al. |
| 2011/0046997 | A1 | 2/2011 | Noureldin et al. |
| 2011/0046998 | A1 | 2/2011 | Noureldin et al. |
| 2011/0054703 | A1* | 3/2011 | Heavner, III ..... B01D 1/0082 700/282 |
| 2011/0054715 | A1 | 3/2011 | Noureldin et al. |
| 2011/0087380 | A1 | 4/2011 | Noureldin |
| 2011/0087475 | A1 | 4/2011 | Noureldin |
| 2011/0106504 | A1 | 5/2011 | Noureldin |
| 2011/0178834 | A1 | 6/2011 | Noureldin |
| 2011/0178835 | A1 | 7/2011 | Noureldin |
| 2012/0179900 | A1 | 7/2012 | Temporelli |
| 2013/0231909 | A1 | 9/2013 | Noureldin et al. |
| 2013/0238154 | A1 | 9/2013 | Noureldin et al. |
| 2013/0245844 | A1 | 9/2013 | Noureldin et al. |
| 2013/0245845 | A1 | 9/2013 | Noureldin et al. |
| 2013/0282184 | A1 | 10/2013 | Noureldin et al. |
| 2013/0325200 | A1 | 12/2013 | Noureldin et al. |
| 2014/0374322 | A1 | 12/2014 | Venkatesh |
| 2015/0275100 | A1 | 10/2015 | Sawai |
| 2015/0376519 | A1 | 12/2015 | Noureldin |
| 2015/0376520 | A1 | 12/2015 | Noureldin |
| 2015/0376521 | A1 | 12/2015 | Noureldin |
| 2015/0377079 | A1 | 12/2015 | Noureldin |
| 2016/0200989 | A1 | 7/2016 | Noureldin et al. |
| 2016/0201997 | A1 | 7/2016 | Noureldin et al. |

OTHER PUBLICATIONS

Barletta et al., "Designing a Crude Unit Heat Exchanger Network," Sour & Heavy, published in 2012, pp. 3-10.

Biyanto, "Green Concept in Engineering Practice," The 1st International Seminar on Science and Technology, Aug. 5, 2015, pp. IS4-1-IS4-7.

Communication Pursuant to Rules 161(1) and 162 EPC issued in European Application No. 17723550.4 on Dec. 18, 2018, 3 pages.

Communication Pursuant to Article 94(3) EPC issued in European Application No. 17723550.4-1101 on Aug. 13, 2019, 4 pages.

Feintuch et al., "It Pays to Modify Existing Crude Preheat Trains to Conserve More Energy," Proceedings from the Fourth Industrial Energy Technology Conference, Apr. 4-7, 1982, pp. 772-781.

Gulf Cooperation Council Examination Report issued in GCC Application No. GC 2017-33373 dated Mar. 5, 2019, 4 pages.

International Search Report and Written Opinion of the International Searching Authority issued in International Application No. PCT/US2017/028317 dated Jun. 28, 2017; 11 pages.

Izyan et al.; "Exergy Analysis for Fuel Reduction Strategies in Crude Distillation Unit"; Energy, vol. 66; Feb. 6, 2014, pp. 891-897.

Rossiter, "Improve Energy Efficiency via Heat Integration," American Institute of Chemical Engineers, Dec. 2010, pp. 33-42.

GCC Examination Report in GCC Appln. No. GC 2017-33373, dated Feb. 26, 2020, 8 pages.

* cited by examiner

REFINERY PRE-HEAT TRAIN SYSTEMS AND METHODS

CROSS-REFERENCE TO RELATED APPLICATION

This application is a continuation of, and claims priority under 35 U.S.C. § 120 to, U.S. patent application Ser. No. 15/444,991, entitled "Refinery Pre-Heat Train Systems and Methods," filed on Feb. 28, 2017, which in turn claims priority under 35 U.S.C. § 119 to U.S. Provisional Patent Application Ser. No. 62/334,095, entitled "Sustainable Refinery Pre-Heat Train Systems and Methods," filed on May 10, 2016, the entire contents of which are incorporated herein by reference.

TECHNICAL FIELD

This specification relates to crude oil refinery pre-heat train (PHT) systems and methods.

BACKGROUND

Oil refineries are vital to the world economy and at the same time major consumers of energy. Petroleum refineries are under increased pressure to minimize emissions of greenhouse gases, mainly carbon dioxide to comply with the upcoming more strict environmental regulations. Energy efficiency optimization is a fast track solution to greenhouse gas emissions reduction due to its impact on energy consumption at the source.

Heat exchangers play a major role in crude oil refineries in energy saving, in general. Distillation is the main consumer of energy in an oil refinery. Crude distillation is a primary processing operation in refineries throughout the world and requires heat, steam and cooling to operate. The crude distillation unit (CDU), which consists of both an atmospheric distillation unit and a vacuum distillation unit, is not the most energy-intensive unit in the oil refinery; however, in terms of energy usage per unit volume (that is, energy per barrel processed), every barrel of crude oil processed in the oil refinery passes through the CDU.

SUMMARY

In a general implementation according to the present disclosure, a crude oil refinery pre-heat train (PHT) includes a crude oil stream pipeline system that extends through the PHT and is configured to carry a stream of crude oil from an inlet of the PHT to a furnace of the PHT; a plurality of heat exchangers positioned in the crude oil stream pipeline system; and a control system configured to actuate: a first plurality of control valves to selectively thermally couple the crude oil stream with a plurality of heat sources in a first section of the PHT, a second plurality of control valves to selectively thermally couple the crude oil stream with a plurality of heat sources in a second section of the PHT, and a third plurality of control valves to selectively thermally couple the crude oil stream with a plurality of heat sources in a third section of the PHT. The plurality of heat exchangers includes the first set of heat exchangers positioned in the crude oil stream pipeline system in a first section of the PHT that includes a portion of the PHT between the inlet of the PHT and one or more de-salters of the PHT; the second set of heat exchangers positioned in the crude oil stream pipeline system in a second section of the PHT that includes a portion of the PHT after the one or more de-salters of the PHT and before one or more pre-flash drums of the PHT; and the third set of heat exchangers positioned in the crude oil stream pipeline system in a third section of the PHT that includes a portion of the PHT after the one or more pre-flash drums of the PHT and before the furnace of the PHT.

In a first aspect combinable with the general implementation, at least a portion of the plurality of heat exchangers are shell-and-tube heat exchangers or plate-and-frame heat exchangers.

In another aspect combinable with any of the previous aspects, each of the plurality of heat exchangers includes an adjustable heat exchange surface area.

In another aspect combinable with any of the previous aspects, the first set of heat exchangers positioned in the crude oil stream pipeline system in the first section of the PHT includes a set of eight heat exchangers.

In another aspect combinable with any of the previous aspects, a first heat exchanger in the set of eight heat exchangers is configured to thermally couple the crude oil stream with a heavy vacuum unit cold front reflux stream of the PHT; a second heat exchanger in the set of eight heat exchangers is configured to thermally couple the crude oil stream with an atmospheric crude tower overhead stream of the PHT; a third heat exchanger in the set of eight heat exchangers is configured to thermally couple the crude oil stream with a crude distillation tower top circulating reflux (top pump around) stream of the PHT; a fourth heat exchanger in the set of eight heat exchangers is configured to thermally couple the crude oil stream with an atmospheric diesel stream of the PHT; a fifth heat exchanger in the set of eight heat exchangers is configured to thermally couple the crude oil stream with an atmospheric Kerosene stream of the PHT; a sixth heat exchanger in the set of eight heat exchangers is configured to thermally couple the crude oil stream with a Naphtha bottom stream of the PHT; a seventh heat exchanger in the set of eight heat exchangers is configured to thermally couple the crude oil stream with a light vacuum gas oil stream of the PHT; and an eighth heat exchanger in the set of eight heat exchangers is configured to thermally couple the crude oil stream with an atmospheric column middle circulating reflux stream of the PHT.

In another aspect combinable with any of the previous aspects, the first, second, and third heat exchanger are serially arranged in the crude oil stream pipeline system, and the third heat exchanger is serially arranged with the fourth through seventh heat exchangers in the crude oil stream pipeline system, and the fourth through seventh heat exchangers are arranged in parallel in the crude oil stream pipeline system, and the eighth heat exchanger is serially arranged with the fourth through seventh heat exchangers in the crude oil pipeline.

In another aspect combinable with any of the previous aspects, the second set of heat exchangers positioned in the crude oil stream pipeline system in the second section of the PHT includes a set of seven heat exchangers.

In another aspect combinable with any of the previous aspects, a first heat exchanger in the set of seven heat exchangers is configured to thermally couple the crude oil stream with a kerosene product stream of the PHT; a second heat exchanger in the set of seven heat exchangers is configured to thermally couple the crude oil stream with a diesel product stream of the PHT; a third heat exchanger in the set of seven heat exchangers is configured to thermally couple the crude oil stream with a light vacuum gas oil stream of the PHT; a fourth heat exchanger in the set of seven heat exchangers is configured to thermally couple the crude oil stream with a heavy vacuum unit middle circulating reflux stream of the PHT; a fifth heat exchanger in the set of seven heat exchangers is configured to thermally couple the crude oil stream with a stabilized naphtha stream of the PHT; a sixth heat exchanger in the set of seven heat exchangers is configured to thermally couple the crude oil stream with a crude distillation unit middle circulating reflux stream of the PHT; and a seventh heat exchanger in the set of seven heat exchangers is configured to thermally couple the crude oil stream with the crude distillation unit middle circulating reflux stream of the PHT.

In another aspect combinable with any of the previous aspects, the first heat exchanger is arranged in parallel with the second heat exchanger in the crude oil stream pipeline system, and the second heat exchanger is arranged in parallel with the third and fourth heat exchangers in the crude oil stream pipeline system, and the third and fourth heat exchangers are serially arranged in the crude oil stream pipeline system, and the third and fourth heat exchangers are arranged in parallel with the fifth and sixth heat exchangers in the crude oil stream pipeline system, and the fifth and sixth heat exchangers are serially arranged in the crude oil stream pipeline system, and the seventh heat exchanger is serially arranged with the first through sixth heat exchangers in the crude oil pipeline.

In another aspect combinable with any of the previous aspects, the third set of heat exchangers positioned in the crude oil stream pipeline system in the third section of the PHT includes a set of fifteen heat exchangers.

In another aspect combinable with any of the previous aspects, a first heat exchanger in the set of fifteen heat exchangers is configured to thermally couple the crude oil stream with a heavy vacuum unit middle circulating reflux of the PHT; a second heat exchanger in the set of fifteen heat exchangers is configured to thermally couple the crude oil stream with a crude distillation unit middle circulating reflux stream of the PHT; a third heat exchanger in the set of fifteen heat exchangers is configured to thermally couple the crude oil stream with a vacuum residue product stream of the PHT; a fourth heat exchanger in the set of fifteen heat exchangers is configured to thermally couple the crude oil stream with a kerosene product stream of the PHT; a fifth heat exchanger in the set of fifteen heat exchangers is configured to thermally couple the crude oil stream with a heavy vacuum gas oil product stream of the PHT; a sixth heat exchanger in the set of fifteen heat exchangers is configured to thermally couple the crude oil stream with a diesel product stream of the PHT; a seventh heat exchanger in the set of fifteen heat exchangers is configured to thermally couple the crude oil stream with a heavy vacuum unit lower circulating reflux stream of the PHT; an eighth heat exchanger in the set of fifteen heat exchangers is configured to thermally couple the crude oil stream with the heavy vacuum unit lower circulating reflux stream of the PHT; a ninth heat exchanger in the set of fifteen heat exchangers is configured to thermally couple the crude oil stream with the vacuum residue product stream of the PHT; a tenth heat exchanger in the set of fifteen heat exchangers is configured to thermally couple the crude oil stream with the heavy vacuum lower circulating reflux stream of the PHT; an eleventh heat exchanger in the set of fifteen heat exchangers is configured to thermally couple the crude oil stream with a crude distillation unit lower circulating reflux stream of the PHT; a twelfth heat exchanger in the set of fifteen heat exchangers is configured to thermally couple the crude oil stream with the vacuum residue product stream of the PHT; a thirteenth heat exchanger in the set of fifteen heat exchangers is configured to thermally couple the crude oil stream with the crude distillation unit lower circulating stream of the PHT; a fourteenth heat exchanger in the set of fifteen heat exchangers is configured to thermally couple the crude oil stream with a hot vacuum stream from column section feed drum stream of the PHT; and a fifteenth heat exchanger in the set of fifteen heat exchangers is configured to thermally couple the crude oil stream with the vacuum residue product stream of the PHT.

In another aspect combinable with any of the previous aspects, the first through third heat exchangers are serially arranged in the crude oil stream pipeline system, and the sixth and seventh heat exchangers are serially arranged in the crude oil stream pipeline system, and the first through third heat exchangers, fourth heat exchanger, fifth heat exchanger, and sixth through seventh heat exchangers are arranged in parallel in the crude oil stream pipeline system.

In another aspect combinable with any of the previous aspects, the eighth heat exchanger is serially arranged with the first through seventh heat exchangers in the crude oil stream pipeline system, the ninth and tenth heat exchangers are arranged in parallel in the crude oil stream pipeline system, and also serially arranged with the first through eighth heat exchangers in the crude oil stream pipeline system, and the eleventh heat exchanger is serially arranged with the first through tenth heat exchangers in the crude oil stream pipeline system.

In another aspect combinable with any of the previous aspects, the twelfth and thirteenth heat exchangers are arranged in parallel in the crude oil stream pipeline system, and also serially arranged with the first through eleventh heat exchangers in the crude oil stream pipeline system, and each of the fourteenth and fifteenth heat exchangers is serially arranged with the first through thirteenth heat exchangers in the crude oil stream pipeline system.

In another aspect combinable with any of the previous aspects, a first portion of the plurality of heat exchangers includes a heat exchange surface area adjustable from an initial design heat exchange surface area to an adjusted design heat exchange surface area that is between 100% and 200% greater than the initial design heat exchange surface area.

In another aspect combinable with any of the previous aspects, a second portion of the plurality of heat exchangers includes a heat exchange surface area adjustable from an initial design heat exchange surface area to an adjusted design heat exchange surface area that is between 13% and 45% less than the initial design heat exchange surface area.

In another aspect combinable with any of the previous aspects, a third portion of the plurality of heat exchangers includes a heat exchange surface area adjustable from an initial design heat exchange surface area to an adjusted design heat exchange surface area that is between 20% and 90% greater than the initial design heat exchange surface area.

In another aspect combinable with any of the previous aspects, a fourth portion of the plurality of heat exchangers includes a heat exchange surface area adjustable from an initial design heat exchange surface area to an adjusted design heat exchange surface area that is up to 300% greater than the initial design heat exchange surface area.

In another aspect combinable with any of the previous aspects, each of the plurality of heat exchangers includes a minimum approach temperature that includes a difference between an entering temperature of a hot fluid and a leaving temperature of the crude oil stream.

In another aspect combinable with any of the previous aspects, the minimum approach temperature is adjustable between about 30° C. and 15° C.

In another general implementation, a method of operating a crude oil refinery pre-heat train (PHT) includes circulating a crude oil stream through a crude oil stream pipeline system that extends through the PHT from an inlet of the PHT to a furnace of the PHT; circulating the crude oil stream through a plurality of heat exchangers positioned in the crude oil stream pipeline system; pre-heating the crude oil stream through the plurality of heat exchangers prior to circulating the pre-heated crude oil stream to the furnace of the PHT; actuating, with a control system, a first plurality of control valves to selectively thermally couple the crude oil stream with a plurality of heat sources in a first section of the PHT; actuating, with the control system, a second plurality of control valves to selectively thermally couple the crude oil stream with a plurality of heat sources in a second section of the PHT; and actuating, with the control system, a third plurality of control valves to selectively thermally couple the crude oil stream with a plurality of heat sources in a third section of the PHT. The plurality of heat exchangers includes the first set of heat exchangers positioned in the crude oil stream pipeline system in a first section of the PHT that includes a portion of the PHT between the inlet of the PHT and one or more de-salters of the PHT; the second set of heat exchangers positioned in the crude oil stream pipeline system in a second section of the PHT that includes a portion of the PHT after the one or more de-salters of the PHT and before one or more pre-flash drums of the PHT; and the third set of heat exchangers positioned in the crude oil stream pipeline system in a third section of the PHT that includes a portion of the PHT after the one or more pre-flash drums of the PHT and before the furnace of the PHT.

In a first aspect combinable with the general implementation, at least a portion of the plurality of heat exchangers are shell-and-tube heat exchangers or plate-and-frame heat exchangers.

In another aspect combinable with any of the previous aspects, the first set of heat exchangers positioned in the crude oil stream pipeline system in the first section of the PHT includes a set of eight heat exchangers.

In another aspect combinable with any of the previous aspects, a first heat exchanger in the set of eight heat exchangers thermally couples the crude oil stream with a heavy vacuum unit cold front reflux stream of the PHT; a second heat exchanger in the set of eight heat exchangers thermally couples the crude oil stream with an atmospheric crude tower overhead stream of the PHT; a third heat exchanger in the set of eight heat exchangers thermally couples the crude oil stream with a crude distillation tower top circulating reflux (top pump around) stream of the PHT; a fourth heat exchanger in the set of eight heat exchangers thermally couples the crude oil stream with an atmospheric diesel stream of the PHT; a fifth heat exchanger in the set of eight heat exchangers thermally couples the crude oil stream with an atmospheric Kerosene stream of the PHT; a sixth heat exchanger in the set of eight heat exchangers thermally couples the crude oil stream with a Naphtha bottom stream of the PHT; a seventh heat exchanger in the set of eight heat exchangers thermally couples the crude oil stream with a light vacuum gas oil stream of the PHT; and an eighth heat exchanger in the set of eight heat exchangers thermally couples the crude oil stream with an atmospheric column middle circulating reflux stream of the PHT.

In another aspect combinable with any of the previous aspects, the first, second, and third heat exchanger are serially arranged in the crude oil stream pipeline system, and the third heat exchanger is serially arranged with the fourth through seventh heat exchangers in the crude oil stream pipeline system, and the fourth through seventh heat exchangers are arranged in parallel in the crude oil stream pipeline system, and the eighth heat exchanger is serially arranged with the fourth through seventh heat exchangers in the crude oil pipeline.

In another aspect combinable with any of the previous aspects, the second set of heat exchangers positioned in the crude oil stream pipeline system in the second section of the PHT includes a set of seven heat exchangers.

In another aspect combinable with any of the previous aspects, a first heat exchanger in the set of seven heat exchangers thermally couples the crude oil stream with a kerosene product stream of the PHT; a second heat exchanger in the set of seven heat exchangers thermally couples the crude oil stream with a diesel product stream of the PHT; a third heat exchanger in the set of seven heat exchangers thermally couples the crude oil stream with a light vacuum gas oil stream of the PHT; a fourth heat exchanger in the set of seven heat exchangers thermally couples the crude oil stream with a heavy vacuum unit middle circulating reflux stream of the PHT; a fifth heat exchanger in the set of seven heat exchangers thermally couples the crude oil stream with a stabilized naphtha stream of the PHT; a sixth heat exchanger in the set of seven heat exchangers thermally couples the crude oil stream with a crude distillation unit middle circulating reflux stream of the PHT; and a seventh heat exchanger in the set of seven heat exchangers thermally couples the crude oil stream with the crude distillation unit middle circulating reflux stream of the PHT.

In another aspect combinable with any of the previous aspects, the first heat exchanger is arranged in parallel with the second heat exchanger in the crude oil stream pipeline system, and the second heat exchanger is arranged in parallel with the third and fourth heat exchangers in the crude oil stream pipeline system, and the third and fourth heat exchangers are serially arranged in the crude oil stream pipeline system, and the third and fourth heat exchangers are arranged in parallel with the fifth and sixth heat exchangers in the crude oil stream pipeline system, and fifth and sixth heat exchanger are serially arranged in the crude oil stream pipeline system, and the seventh heat exchanger is serially arranged with the first through sixth heat exchangers in the crude oil pipeline.

In another aspect combinable with any of the previous aspects, the third set of heat exchangers positioned in the crude oil stream pipeline system in the third section of the PHT includes a set of fifteen heat exchangers.

In another aspect combinable with any of the previous aspects, a first heat exchanger in the set of fifteen heat exchangers thermally couples the crude oil stream with a heavy vacuum unit middle circulating reflux of the PHT; a second heat exchanger in the set of fifteen heat exchangers thermally couples the crude oil stream with a crude distillation unit middle circulating reflux stream of the PHT; a third heat exchanger in the set of fifteen heat exchangers thermally couples the crude oil stream with a vacuum residue product stream of the PHT; a fourth heat exchanger in the set of fifteen heat exchangers thermally couples the crude oil stream with a kerosene product stream of the PHT; a fifth heat exchanger in the set of fifteen heat exchangers thermally couples the crude oil stream with a heavy vacuum gas oil product stream of the PHT; a sixth heat exchanger in the set of fifteen heat exchangers thermally couples the crude oil stream with a diesel product stream of the PHT; a seventh heat exchanger in the set of fifteen heat exchangers thermally couples the crude oil stream with a heavy vacuum unit lower circulating reflux stream of the PHT; an eighth heat exchanger in the set of fifteen heat exchangers thermally couples the crude oil stream with the heavy vacuum unit lower circulating reflux stream of the PHT; a ninth heat exchanger in the set of fifteen heat exchangers thermally couples the crude oil stream with the vacuum residue product stream of the PHT; a tenth heat exchanger in the set of fifteen heat exchangers thermally couples the crude oil stream with the heavy vacuum lower circulating reflux stream of the PHT; an eleventh heat exchanger in the set of fifteen heat exchangers thermally couples the crude oil stream with a crude distillation unit lower circulating reflux stream of the PHT; a twelfth heat exchanger in the set of fifteen heat exchangers thermally couples the crude oil stream with the vacuum residue product stream of the PHT; a thirteenth heat exchanger in the set of fifteen heat exchangers thermally couples the crude oil stream with the crude distillation unit lower circulating stream of the PHT; a fourteenth heat exchanger in the set of fifteen heat exchangers thermally couples the crude oil stream with a hot vacuum stream from column section feed drum stream of the PHT; and a fifteenth heat exchanger in the set of fifteen heat exchangers thermally couples the crude oil stream with the vacuum residue product stream of the PHT.

In another aspect combinable with any of the previous aspects, the first through third heat exchangers are serially arranged in the crude oil stream pipeline system, and the sixth and seventh heat exchangers are serially arranged in the crude oil stream pipeline system, and the first through third heat exchangers, fourth heat exchanger, fifth heat exchanger, and sixth through seventh heat exchangers are arranged in parallel in the crude oil stream pipeline system.

In another aspect combinable with any of the previous aspects, the eighth heat exchanger is serially arranged with the first through seventh heat exchangers in the crude oil stream pipeline system.

In another aspect combinable with any of the previous aspects, the ninth and tenth heat exchangers are arranged in parallel in the crude oil stream pipeline system, and also serially arranged with the first through eighth heat exchangers in the crude oil stream pipeline system.

In another aspect combinable with any of the previous aspects, the eleventh heat exchanger is serially arranged with the first through tenth heat exchangers in the crude oil stream pipeline system.

In another aspect combinable with any of the previous aspects, the twelfth and thirteenth heat exchangers are arranged in parallel in the crude oil stream pipeline system, and also serially arranged with the first through eleventh heat exchangers in the crude oil stream pipeline system.

In another aspect combinable with any of the previous aspects, each of the fourteenth and fifteenth heat exchangers are serially arranged with the first through thirteenth heat exchangers in the crude oil stream pipeline system.

Another aspect combinable with any of the previous aspects further includes performing at least one of adjusting a heat exchange surface area of a first portion of the plurality of heat exchangers from an initial design heat exchange surface area to an adjusted design heat exchange surface area that is between 100% and 200% greater than the initial design heat exchange surface area; adjusting a heat exchange surface area of a second portion of the plurality of heat exchangers from an initial design heat exchange surface area to an adjusted design heat exchange surface area that is between 13% and 45% less than the initial design heat exchange surface area; adjusting a heat exchange surface area of a third portion of the plurality of heat exchangers from an initial design heat exchange surface area to an adjusted design heat exchange surface area that is between 20% and 90% greater than the initial design heat exchange surface area; or adjusting a heat exchange surface area of a fourth portion of the plurality of heat exchangers from an initial design heat exchange surface area to an adjusted design heat exchange surface area that is up to 300% greater than the initial design heat exchange surface area.

In another aspect combinable with any of the previous aspects, each of the plurality of heat exchangers includes a minimum approach temperature that includes a difference between an entering temperature of a hot fluid and a leaving temperature of the crude oil stream.

Another aspect combinable with any of the previous aspects further includes adjusting the minimum approach temperature.

In another aspect combinable with any of the previous aspects, adjusting the minimum approach temperature includes adjusting the minimum approach temperature from 30° C. to 15° C.

Another aspect combinable with any of the previous aspects further includes, based on adjusting the minimum approach temperature, adjusting a thermal duty of one or more of the plurality of heat exchangers.

In another aspect combinable with any of the previous aspects, adjusting a thermal duty of one or more of the plurality of heat exchangers includes at least one of adjusting an amount of a heat exchange surface area of the one or more of the plurality of heat exchangers; or adjusting a material of the heat exchange surface area of the one or more of the plurality of heat exchangers.

In another aspect combinable with any of the previous aspects, adjusting an amount of a heat exchange surface area of the one or more of the plurality of heat exchangers includes at least one of adding or removing tubes in the one or more of the plurality of heat exchangers; or adding or removing plates in the one or more of the plurality of heat exchangers.

Implementations of a crude oil refinery PHT according to the present disclosure may include one, some, or all of the following features. For example, implementations may enable the cold crude oil stream of medium grade and mixed grade crude oils to use the same topology with minimum energy consumption, compared with conventional PHT systems, in the crude furnace before the atmospheric distillation column without any structural modifications along the oil refinery lifetime through heat exchanger surface areas manipulation. Implementations may enable the crude oil refinery operators and owners to develop a future plan that accounts for the needs for future crude distillation units furnace debottlenecking, energy saving projects, or both. Implementations of the present disclosure may include example details of the PHT design for a minimum approach temperatures range of 30° C. to 15° C. and thermal duties (Q) of heat exchangers megawatts and temperatures in degrees Celsius. The energy savings of implementations described in the present disclosure compared with a state-of-the-art, new refinery PHT configuration may be up to about 30 MW of fuel saving. This savings can increase even more by up to about 50% to save up to about 50 MW of fuel using the described implementations with more heat exchanger surface area manipulation. Taking into consideration that oil refineries can operate about 50 years, the missed opportunity in both fossil fuel saving and fuel-based greenhouse gas emissions reductions in conventional refinery PHT designs is significant. Taking also into consideration that each barrel of oil going to oil refineries worldwide goes through the PHT, the worldwide missed opportunity in conventional PHT design may also be significant and increasing with time.

The details of one or more implementations of the subject matter described in this disclosure are set forth in the accompanying drawings and the description below. Other features, aspects, and advantages of the subject matter will become apparent from the description, the drawings, and the claims.

Figure 1A:
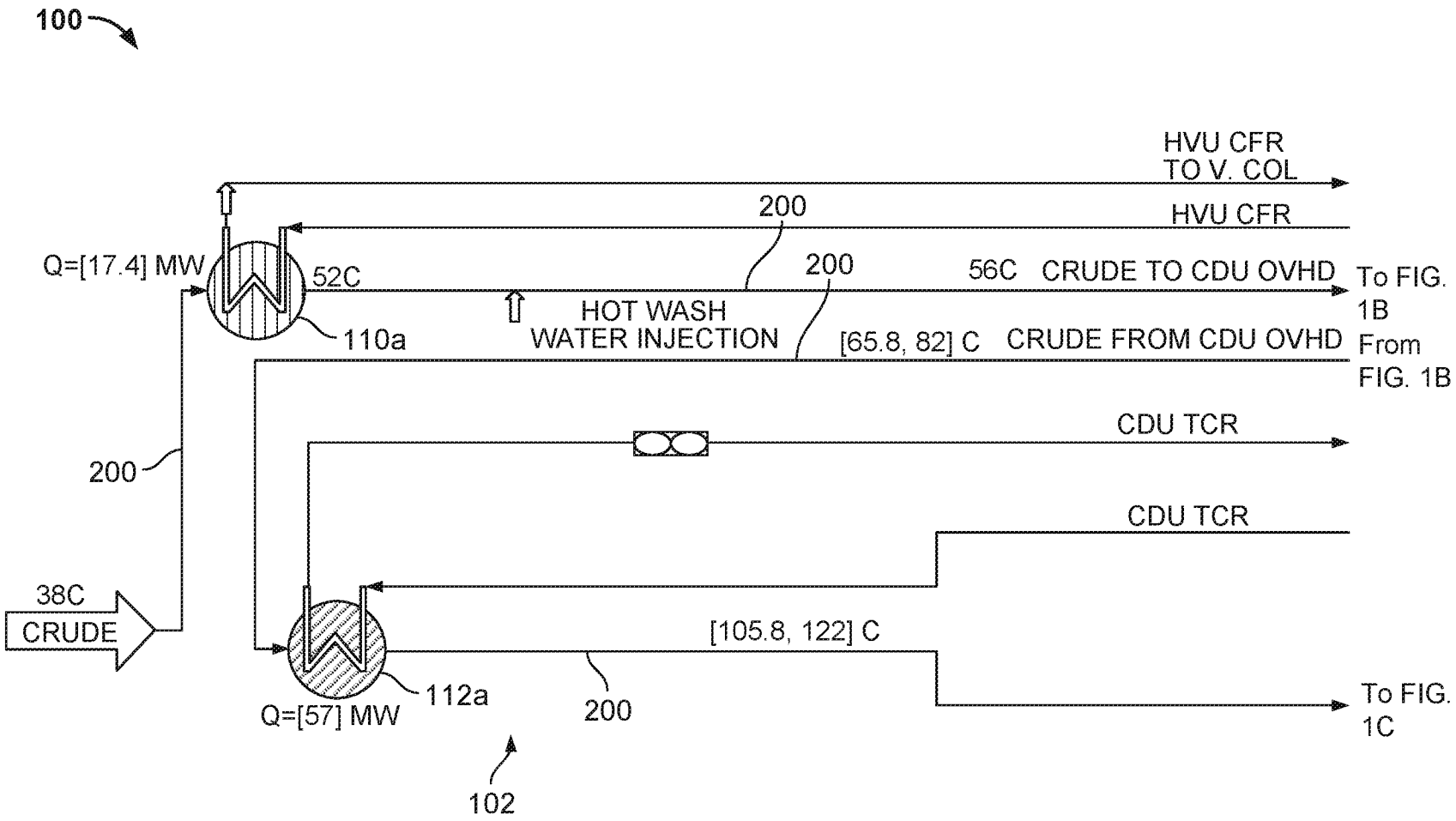
FIGS. 1A-1C are schematic illustrations of a crude oil stream flowing through one or more heat exchangers before prior to de-salting in a refinery pre-heat train (PHT).

Abbreviations for the drawings and present disclosure include those in Table 1:

TABLE 1

| Abbreviation | Description |
|---|---|
| CFR | Cold front reflux |
| TCR | Top circulating reflux |
| MCR | Middle circulating reflux |
| LCR | Lower circulating reflux |
| HVGO | Heavy vacuum gas oil |
| LVGO | Light vacuum gas oil |
| CDU | Crude distillation unit |
| HVU | High vacuum unit |
| ATM° COL | Atmospheric column |
| V(AC)° COL | Vacuum column |
| PHT | Pre-heat train |
| Kero | Kerosene |
| C | Celsius |
| MW | Megawatt |
| Q | Thermal duty |

DETAILED DESCRIPTION

This present disclosure describes energy efficient healthy aging design of crude oil refineries distillation unit PHT. Implementations described in the present disclosure relate to energy efficient configuration of integrated crude oil atmospheric and vacuum distillation unit PHT. Implementations described in the present disclosure relate to pre-heat sustainable designs from energy consumption efficiency and fossil fuel-based greenhouse gas emissions along the crude oil refinery lifetime; through, for example, a pre-heat train heat exchanger surface area adjustment. The described pre-heat topology design may be fixed and correct from the beginning of the oil refinery commissioning up to the refinery end-of-service.

Crude distillation is a primary processing operation in refineries throughout the world and requires heat, steam and cooling to operate. Although the CDU, that consists of both an ADU and a VDU, is not the most energy-intensive plant in the oil refinery, in terms of energy per barrel, every barrel of crude oil that is processed in the oil refinery passes through this unit/plant, making it the largest energy consumer, of the total energy consumed, in crude oil refineries.

The crude distillation process separates crude oil into fractions according to the relative boiling points of such fractions, so that downstream processing units/plants can be charged with feedstock that meets particular specifications. For example, the crude oil separation process is accomplished by first fractionating crude oil at essentially atmospheric pressure and then feeding the high-boiling fraction, called topped crude or reduced crude, from the atmospheric distillation tower to a second fractionation tower that is operated under vacuum conditions. The crude oil vacuum distillation unit is used to avoid the high temperatures necessary to vaporize topped crude at atmospheric pressure. This unit reduces the risk of thermal cracking, product discoloration, and equipment fouling due to coke formation. Before entering the atmospheric distillation tower flash zone, the crude oil charge is heated to the desired desalting temperature, desalted, heated again to separate light fractions vapor in a pre-flash drum or pre-flash tower, heated up again before the atmospheric unit furnace using product streams and column reflux streams, known as pumparounds. The desalted and pre-flashed crude oil charge is heated up in the atmospheric distillation furnace(s) to about 375° C. Topped crude from the atmospheric tower bottom, sometimes called reduced crude, is mixed with steam and preheated to about 390° C. to 450° C. before routed to the vacuum distillation tower. A system of vacuum pumps or steam ejectors is used to create a sub-atmospheric condition in the vacuum distillation column for the separation of high boiling temperature cuts while mitigating thermally-induced chemical degradation.

Crude oil distillation plant design includes the PHT. The retrofit of the crude distillation plant, including the PHT, may be conducted at least four to five times along the crude oil refinery lifetime not only due to the need for energy saving, greenhouse gas emissions reduction, as well as for throughput increase, for product mix/specification (more gasoline than diesel or vice versa), and for permanent change in the API of the processed crude oil. Since the atmospheric and vacuum crude distillation towers designs are highly interlinked to the crude distillation plant PHT, any retrofit of one system is going to severely impact the other.

All of these objectives result in heat duties within the PHT to be changed, heat exchanger surface areas to be changed, pressure drop in the PHT to change, a need for adding new heat exchangers units, a need for changing unit sequence, a need to split stream, a need even for new stream matching, a need to change the atmospheric or vacuum towers internals, a need to change crude pumps, and other changes. Such situations may bring hard constraints to any plant owner to start any retrofit on the basis of energy saving or energy-based greenhouse gas emissions reduction in particular, unless it is absolutely necessary for unit de-bottlenecking via the furnace de-bottlenecking to allow throughput increase. In such situations, there may be opportunities to save energy consumption and reduce energy based-greenhouse gas emissions that are overlooked.

PHT design modifications in the crude oil distillation plant may depend not only on the retrofit needs of the PHT, but also on the constraints related to distillation towers. Interaction between the atmospheric and vacuum distillation towers, products and inter-coolers (top pump around, middle pump around and bottom pump around) of both columns' conditions beside hydraulic situations may create a complex problem to the process owners. This problem may require re-consideration of changes on the basis of energy savings only or emissions reduction, or both, for any design modification, especially if such changes, if implemented, need long downtime of the plant. Such constraints (for example, downtime for crane work, re-piping, or reconfiguration of control equipment) often make the decision makers of any crude oil distillation plant to completely avoid any attempt to change the PHT design and only consider the modifications which mostly utilize an initial PHT design with minimal changes.

Indeed, to move one heat exchanger in the crude distillation plant PHT to a new location to be matched with another stream may be quite difficult not only because it needs crane work and down time but also more involved engineering design work to design the new pipework required and the pipe rack capability to accommodate the new portion of the piping system, including the PHT re-piping required, civil work, instrumentation and control modifications material of construction selection, safety study/HAZOP, and other work. In many situations in the crude distillation plant's PHT area, congestion may not even allow such modifications at all and if allowed; the pipework modifications might be very expensive. In such situations, the re-use of existing heat exchangers, at least from the standpoint of, for example, heat exchanger surface area or materials of construction, may be another unfeasible situation to consider for enhancing the PHT energy efficiency.

Adding new heat exchangers in the PHT to enhance the energy efficiency of the crude distillation plant PHT through the re-matching of streams between the crude oil cold stream and the hot products, even if beneficial from an energy saving point of view, may not be feasible because of the previously described constraints. Further, there may be no or very few easy ways to proceed on the basis of energy saving merits alone. In many other situations, the original design of the PHT may not have any merit in completing modifications to save energy without completely revisiting the crude distillation plant PHT original design plot plan and re-do such design. Therefore, if the original crude distillation plant PHT design is not correct from the beginning, plant owners/operators may be constrained with the existing distillation towers and PHT design plot and there may be very limited opportunity to enhance the PHT energy performance. In other words, the original design may not be changeable for energy improvement at all along its lifetime.

Therefore, there may be benefits to the crude oil refineries to design the PHT design correctly (for example, for best energy efficiency throughout the lifetime of the PHT) from the beginning with a capability to capture waste energy with no topological modification of its original design. For example, a worldwide 0.1% reduction in the PHT furnace's fuel consumption per day (which is a very small saving in energy consumption) can be important to both fossil fuel energy consumption reduction and the fossil fuel-based-greenhouse gas emission targets in crude oil refineries (for example, about 100,000 Barrel Oil Equivalents/day (BOE) due to the fact that each barrel of world crude oil goes through the crude oil distillation plants. Most of the current crude oil refineries may not be able to achieve the 0.1% energy saving in future retrofit projects with their original PHT design without a huge cost, not only in the heat exchanger network retrofit, but also in refinery operation downtime.

The present disclosure describes implementations of a PHT design configuration for both medium grade crude oil and medium-heavy mixed grade crude oil that avoids the previously mentioned problems and also minimizes furnace fuel consumption along its lifetime. For example, the implementations may render a lifetime healthy aging energy efficient medium-to-heavy-grade crude oil distillation plant PHT configuration. Further, the implementations may render a design that is valid for all possible PHT heat exchangers minimum approach temperatures among hot and cold streams. As another example, the implementations may render an energy efficient fixed configuration that renders the highest crude unit furnace inlet temperature via the addition or bypass, or both, of specific heat exchangers in the network.

Implementations of a PHT design described in the present disclosure may render an energy efficient design that is fixed along the crude oil refinery lifetime without any change in its topology such as re-sequencing of heat exchangers units, re-matching or adding of new units to be able to capture energy saving along the PHT lifetime due to the escalation in energy prices. Implementations of a PHT design described in the present disclosure may have, in addition to current scaling and fouling problems mitigation methods in crude oil unit PHT designs (for example, chemical methods using additives; solvents, biocides and chlorination, or mechanical methods using heat transfer enhancement including tube inserts; helical baffles, cleaning devices such as abrasives; offline cleaning), a change of: material of construction, bundle type, or heat exchanger side (for example, from shell to tube or vice versa).

Implementations of the PHT design described in the present disclosure may also include, for example, variable speed pump(s) after the pre-flash drum, and the new use of extra stand-by shells (in shell-and-tube types) or plates (in plate-and-frame types) or new units from any other heat exchangers units type. The standby shell(s) or unit(s) location(s) in the PHT design may be specified in the heat exchanger just before the furnace for all types of crudes processed, or, according to the type of crude processed, at parallel heat exchangers preceding the crude unit furnace.

Implementations of the PHT design described in the present disclosure may have a fixed crude oil stream path. This crude oil path, in example implementations, may be divided into three sections. The first section starts from the crude inlet to the refinery up to the de-salter(s). The second section starts after the de-salter to the pre-flash drum/tower. The third section starts after the pre-flash drum up to the atmospheric crude furnace. In some implementations, the third section has two parts: the first part ends where the whole crude stream goes through one heat exchanger where most of the fouling starts to accelerate, especially for certain types of crudes. In some implementations, the heat exchangers' thermal loads along the crude oil stream path may change along the design lifetime and consequently, the heat exchanger surface areas may change too, but the topology itself (structure) is fixed along the whole PHT.

Heat Exchangers

In the configurations described in this disclosure, heat exchangers are used to transfer heat from one medium (for example, a stream flowing through a plant in a crude oil refining PHT, a buffer fluid or other medium) to another medium (for example, a crude oil stream flowing through a plant in the crude oil PHT). Heat exchangers are devices which transfer (exchange) heat typically from a hotter fluid stream to a relatively less hotter fluid stream. Heat exchangers can be used in heating and cooling applications, for example, in refrigerators, air conditions or other cooling applications. Heat exchangers can be distinguished from one another based on the direction in which liquids flow. For example, heat exchangers can be parallel-flow, cross-flow or counter-current. In parallel-flow heat exchangers, both fluid involved move in the same direction, entering and exiting the heat exchanger side-by-side. In cross-flow heat exchangers, the fluid path runs perpendicular to one another. In counter-current heat exchangers, the fluid paths flow in opposite directions, with one fluid exiting whether the other fluid enters. Counter-current heat exchangers are sometimes more effective than the other types of heat exchangers.

In addition to classifying heat exchangers based on fluid direction, heat exchangers can also be classified based on their construction. Some heat exchangers are constructed of multiple tubes. Some heat exchangers include plates with room for fluid to flow in between. Some heat exchangers enable heat exchange from liquid to liquid, while some heat exchangers enable heat exchange using other media.

Heat exchangers in crude oil refining and petrochemical facilities are often shell-and-tube type heat exchangers which include multiple tubes through which liquid flows. The tubes are divided into two sets—the first set contains the liquid to be heated or cooled; the second set contains the liquid responsible for triggering the heat exchange, in other words, the fluid that either removes heat from the first set of tubes by absorbing and transmitting the heat away or warms the first set by transmitting its own heat to the liquid inside. When designing this type of exchanger, care must be taken in determining the correct tube wall thickness as well as tube diameter, to allow optimum heat exchange. In terms of flow, shell-and-tube heat exchangers can assume any of three flow path patterns.

Heat exchangers in crude oil refining and petrochemical facilities can also be plate-and-frame type heat exchangers. Plate heat exchangers include thin plates joined together with a small amount of space in between, often maintained by a rubber gasket. The surface area is large, and the corners of each rectangular plate feature an opening through which fluid can flow between plates, extracting heat from the plates as it flows. The fluid channels themselves alternate hot and cold liquids, meaning that the heat exchangers can effectively cool as well as heat fluid. Because plate heat exchangers have large surface area, they can sometimes be more effective than shell-and-tube heat exchangers. Both shell-and-tube and plate-and-frame heat exchangers may be reconfigured over time to adjust (for example, increase or decrease) their respective heat transfer capability (that is, their thermal duty). Such reconfigurations can include, for example, an addition or removal of tubes, a change to a tube material, an additional or removal of plates, or a change to a plate material, or a combination of changes.

Other types of heat exchangers can include regenerative heat exchangers and adiabatic wheel heat exchangers. In a regenerative heat exchanger, the same fluid is passed along both sides of the exchanger, which can be either a plate heat exchanger or a shell-and-tube heat exchanger. Because the fluid can get very hot, the exiting fluid is used to warm the incoming fluid, maintaining a near constant temperature. Energy is saved in a regenerative heat exchanger because the process is cyclical, with almost all relative heat being transferred from the exiting fluid to the incoming fluid. To maintain a constant temperature, a small quantity of extra energy is needed to raise and lower the overall fluid temperature. In the adiabatic wheel heat exchanger, an intermediate liquid is used to store heat, which is then transferred to the opposite side of the heat exchanger. An adiabatic wheel consists of a large wheel with threats that rotate through the liquids—both hot and cold—to extract or transfer heat. The heat exchangers described in this disclosure can include any one of the heat exchangers described earlier, other heat exchangers, or combinations of them.

Each heat exchanger in each configuration can be associated with a respective thermal duty (or heat duty). The thermal duty of a heat exchanger can be defined as an amount of heat that can be transferred by the heat exchanger from the hot stream to the cold stream. The amount of heat can be calculated from the conditions and thermal properties of both the hot and cold streams. From the hot stream point of view, the thermal duty of the heat exchanger is the product of the hot stream flow rate, the hot stream specific heat, and a difference in temperature between the hot stream inlet temperature to the heat exchanger and the hot stream outlet temperature from the heat exchanger. From the cold stream point of view, the thermal duty of the heat exchanger is the product of the cold stream flow rate, the cold stream specific heat and a difference in temperature between the cold stream outlet from the heat exchanger and the cold stream inlet temperature from the heat exchanger. In several applications, the two quantities can be considered equal assuming no heat loss to the environment for these units, particularly, where the units are well insulated. The thermal duty of a heat exchanger can be measured in watts (W), megawatts (MW), millions of British Thermal Units per hour (Btu/hr), or millions of kilocalories per hour (Kcal/h). In the configurations described here, the thermal duties of the heat exchangers are provided as being "about X MW," where "X" represents a numerical thermal duty value. The numerical thermal duty value is not absolute. That is, the actual thermal duty of a heat exchanger can be approximately equal to X, greater than X or less than X.

Flow Control System

In each of the configurations described later, process streams (also called "streams") are flowed within a crude oil refining PHT. The process streams can be flowed using one or more flow control systems implemented throughout the crude oil refining PHT. A flow control system can include one or more flow pumps to pump the process streams, one or more flow pipes through which the process streams are flowed, and one or more valves to regulate the flow of streams through the pipes.

In some implementations, a flow control system can be operated manually. For example, an operator can set a flow rate for each pump and set valve open or close positions to regulate the flow of the process streams through the pipes in the flow control system. Once the operator has set the flow rates and the valve open or close positions for all flow control systems distributed across the crude oil refining PHT, the flow control system can flow the streams within a plant or between plants under constant flow conditions, for example, constant volumetric rate or other flow conditions. To change the flow conditions, the operator can manually operate the flow control system, for example, by changing the pump flow rate or the valve open or close position.

In some implementations, a flow control system can be operated automatically. For example, the flow control system can be connected to a computer system to operate the flow control system. The computer system can include a computer-readable medium storing instructions (such as flow control instructions and other instructions) executable by one or more processors to perform operations (such as flow control operations). An operator can set the flow rates and the valve open or close positions for all flow control systems distributed across the crude oil refining facility using the computer system. In such implementations, the operator can manually change the flow conditions by providing inputs through the computer system. Also, in such implementations, the computer system can automatically (that is, without manual intervention) control one or more of the flow control systems, for example, using feedback systems implemented in one or more plants and connected to the computer system. For example, a sensor (such as a pressure sensor, temperature sensor or other sensor) can be connected to a pipe through which a process stream flows. The sensor can monitor and provide a flow condition (such as a pressure, temperature, or other flow condition) of the process stream to the computer system. In response to the flow condition exceeding a threshold (such as a threshold pressure value, a threshold temperature value, or other threshold value), the computer system can automatically perform operations. For example, if the pressure or temperature in the pipe exceeds the threshold pressure value or the threshold temperature value, respectively, the computer system can provide a signal to the pump to decrease a flow rate, a signal to open a valve to relieve the pressure, a signal to shut down process stream flow, or other signals.

FIGS. 1A-1C, 2, and 3A-3B illustrate a first section 102 (FIGS. 1A-1C), a second section 104 (FIG. 2), and a third section 106 (FIGS. 3A-3B) of a PHT 100 of a crude oil refinery. The PHT 100 shown in these figures, and with the accompanying detail on the figures, describes a PHT design that starts its lifetime operation at a minimum approach temperature (minimum temperature difference between the hot and cold streams) equal to 30° C. and moves along its life to the half of its initial minimum approach temperature of 15° C.

Figure 1B:
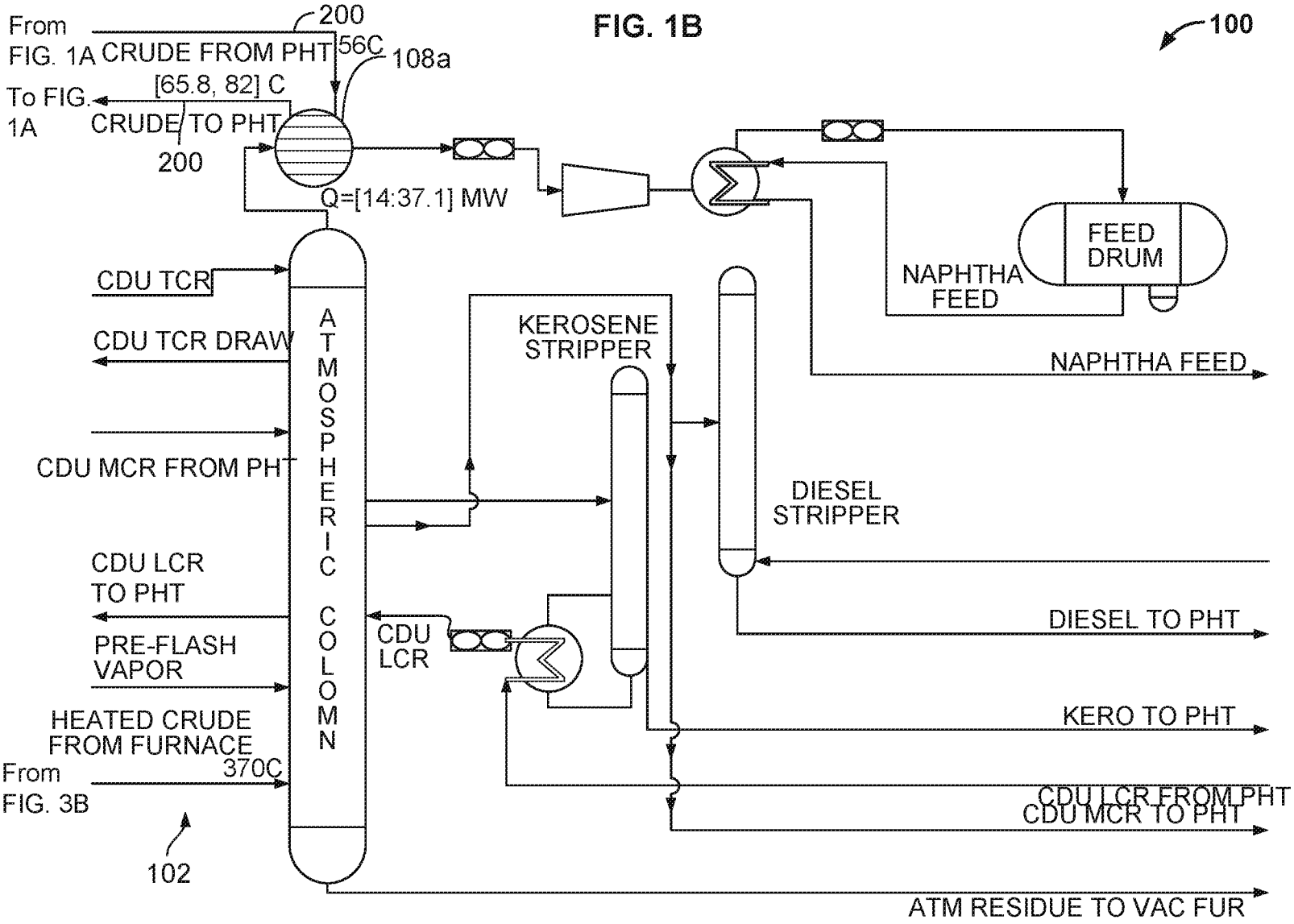
Figure 1C:
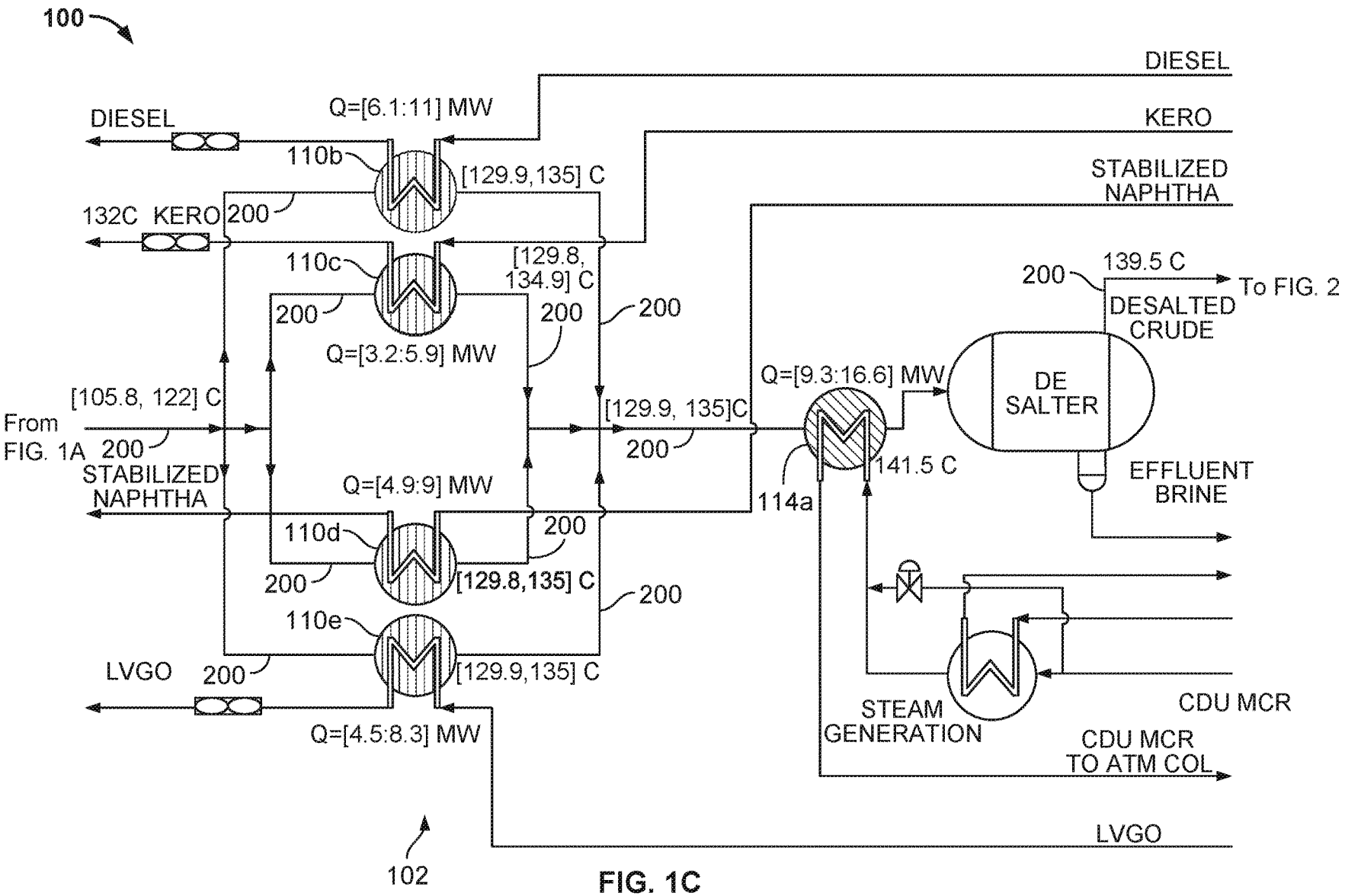

FIGS. 1A-1C are schematic illustrations of a crude oil stream flowing through one or more heat exchangers prior to de-salting in a refinery pre-heat train (PHT) 100. Thus, as described previously, FIGS. 1A-1C illustrate a crude oil stream path 200 through a first section 102 of the PHT 100, for example, from the crude inlet to the refinery up to the de-salter(s). The first section 102 of the PHT includes a heat exchanger network including heat exchangers 108*a* (FIG. 1B), 110*a* and 112*a* (FIG. 1A), and 110*b*-110*e* and 114*a* (FIG. 1C). The crude oil stream 200 flow through these heat exchangers in the order of: 110*a*, then 108*a*, then 112*a*, then 110*b*-110*e* (which are in parallel), then 114*a*.

Turning to FIGS. 1A-1B, the crude oil stream 200 is heated from about 38° C. to about 106-122° C. using three hot streams: the heavy vacuum unit cold front reflux in heat exchanger 110*a*; the atmospheric crude tower overhead stream in heat exchanger 108*a*, in FIG. 1B, and the crude distillation tower top circulating reflux (top pump around) in heat exchanger 112*a* (in that order). The thermal loads shown in FIG. 1A depict the thermal loads of the heat exchanger 110*a*, and heat exchanger 112*a* of about 17.4 MW and 57 MW, respectively, along the design lifetime between its start, at minimum approach temperature of 30° C., to a future stage where the original minimum approach temperature has been halved to 15° C.

The thermal loads shown in FIG. 1B depicts the thermal loads of the heat exchanger 108*a* of about 14 MW to 37 MW in heat exchanger 108*a* of the section 102 design lifetime between the initial start, at minimum approach temperature of 30° C., to a future stage where the original minimum approach temperature has been halved to 15° C.

The atmospheric column section in PHT 100 includes heat exchanger 108*a*. Heat exchanger 108*a* is directly used in the crude stream pre-heat train design, which is the atmospheric column overhead vapor stream used to heat up the crude stream at the inlet to the oil refinery from about 56° C. to about 66° C. to 82° C. with a thermal load of about 14 MW to 37 MW. The thermal loads shown in FIG. 1B depict the thermal loads at the initial minimum approach temperature of 30° C., to a future stage where the original minimum approach temperature has been halved to 15° C.

The crude oil stream 200 in section 102 is split after heat exchanger 112*a* and circulated in parallel through the heat exchangers 110*b*-110*e*. The crude oil stream 200 is therefore heated before the de-salter in FIG. 1C through heat exchangers 110*b*-110*e* from about 106-122° C. to about 141.5° C. using four plus one (4+1) hot streams: the atmospheric Diesel stream in heat exchanger 110*b*; the atmospheric Kerosene stream in heat exchanger 110*c*, the Naphtha bottom stream in heat exchanger 110*d*, and the light vacuum gas oil stream in heat exchanger 110*e*. The crude oil stream 200 is then combined back into a single flow after heat exchangers 110*b*-110*e* and heated by the fifth stream: the atmospheric column middle circulating reflux in heat exchanger 114*a*. The thermal loads shown in FIG. 1C depict the thermal loads of the heat exchangers 110*b* through 110*e* of about 6-11 MW, 3-6 MW, 5-9 MW, and 4.5-8 MW. The thermal loads shown in FIG. 1C depict the thermal load of the heat exchanger 114*a* of about 9-17 MW. These thermal loads are depicted along the PHT 100 in the section 102 in a design lifetime between its initial start, at minimum approach temperature of 30° C., to a future stage where the original minimum approach temperature has been halved to 15° C.

As shown, the crude oil stream 200 is divided into four portions to cool down the products from the atmospheric column in 110*b* through 110*e*, where the stream 200 is heated up to about 130-135° C. The crude oil stream 200 is then sent to the de-salter at a temperature of 141.5° C. and leaves the de-salting section after the stream 200 is de-salted at a temperature of 139.5° C.

Figure 2:
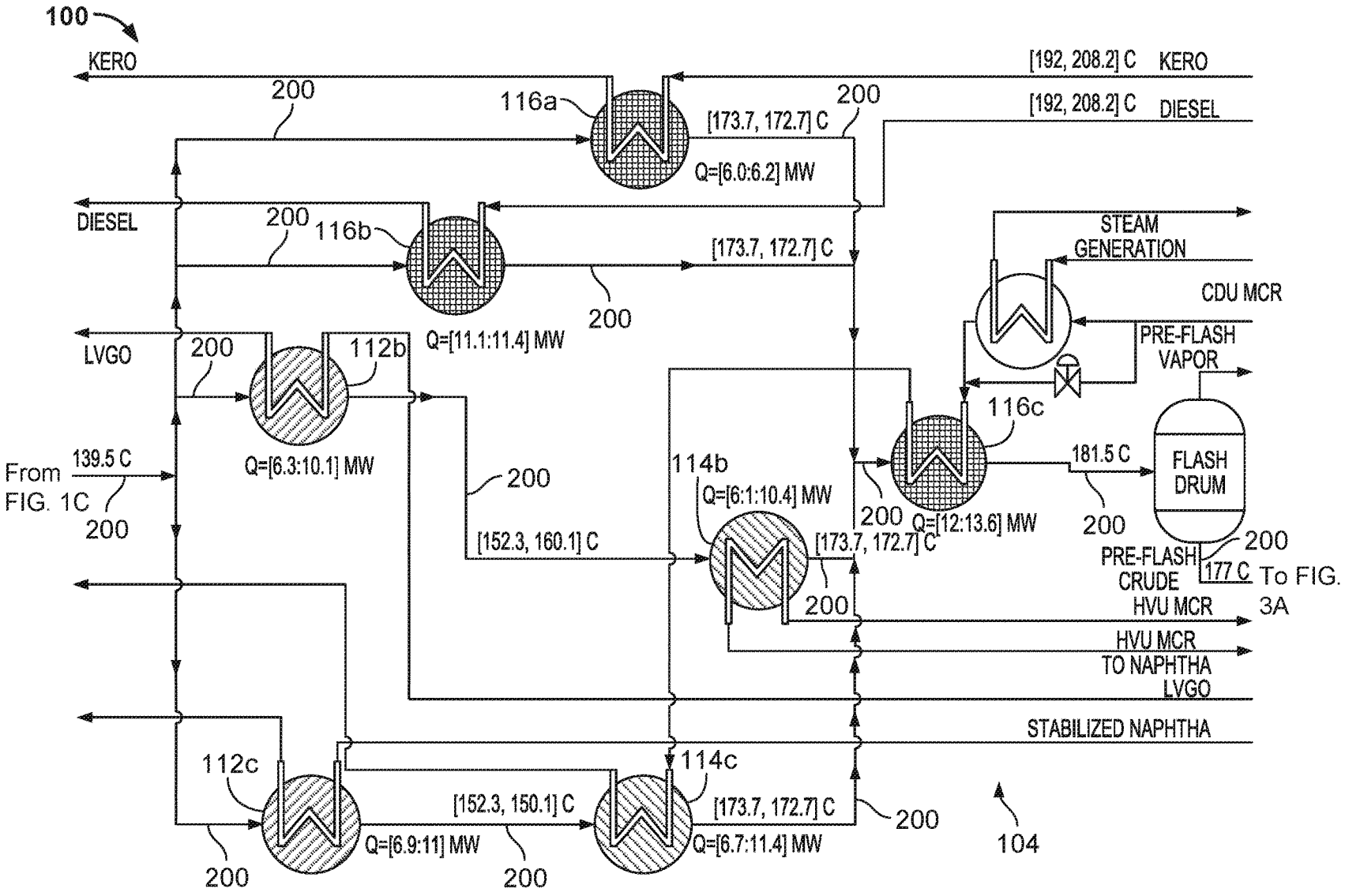
FIG. 2 is a schematic illustration of a crude oil stream flowing through one or more heat exchangers between de-salting and flashing in a refinery PHT.

FIG. 2 is a schematic illustration of the crude oil stream 200 flowing through one or more heat exchangers between de-salting and flashing in a second section 104 of the PHT 100. As described previously, FIG. 2 illustrates the crude oil stream path 200 from the de-salter(s) to the pre-flash drum/tower. The second section 104 of the PHT 100 includes a heat exchanger network including heat exchangers 116*a*, 116*b*, 112*b*, 112*c*, 114*b*, 114*c*, and 116*c*. In section 104, the crude oil stream 200 flows through heat exchanger 116*a*, which is in parallel with heat exchanger 116*b*, which is in parallel with a series of heat exchangers 112*b* and 114*b*, which is also in parallel with a series of heat exchangers 112*c* and 114*c*. Then, the crude oil stream 200 flows through heat exchanger 116*c*.

The crude oil stream 200 after the de-salter and before the pre-flash drum in FIG. 2 is heated from about 139.5° C. to about 181.5° C. using six hot streams: kerosene product in heat exchanger 116*a*; diesel product in heat exchanger 116*b*, light vacuum gas oil in heat exchanger 112*b*, stabilized naphtha in heat exchanger 112*c*, heavy vacuum unit middle circulating reflux in heat exchanger 114*b* and crude distillation unit middle circulating reflux stream in both heat exchangers units 114*c* and 116*c*.

The crude oil stream 200, as shown in FIG. 2, is divided into three portions to cool down the hot product streams and reflux streams where the crude stream 200 is heated up to about 173-174° C. (in heat exchangers 116*a*, 116*b*, 112*b*, 112*c*, 114*b*, and 114*c*) before the crude stream 200 is circulated back to a single stream and heated by heat exchanger 116*c* and sent to the pre-flash temperature at 181.5° C. The stabilized crude stream 200 leaves the pre-flash drum from the bottom at about 177° C.

The thermal loads shown in FIG. 2 depict the thermal loads of the heat exchangers 112*b*, 112*c*, 116*a*, 116*b*, 114*c*, 114*b*, and 116*c* of about 6-10 MW, 7-11 MW, 11.1-11.4 MW, 6.0-6.2 MW, 7-11 MW, 6-10 MW, and 12-13.6 MW, respectively, of second section 104 during its design life between the initial start, at minimum approach temperature of 30° C., to a future stage where the original minimum approach temperature has been halved to 15° C.

Figure 3A:
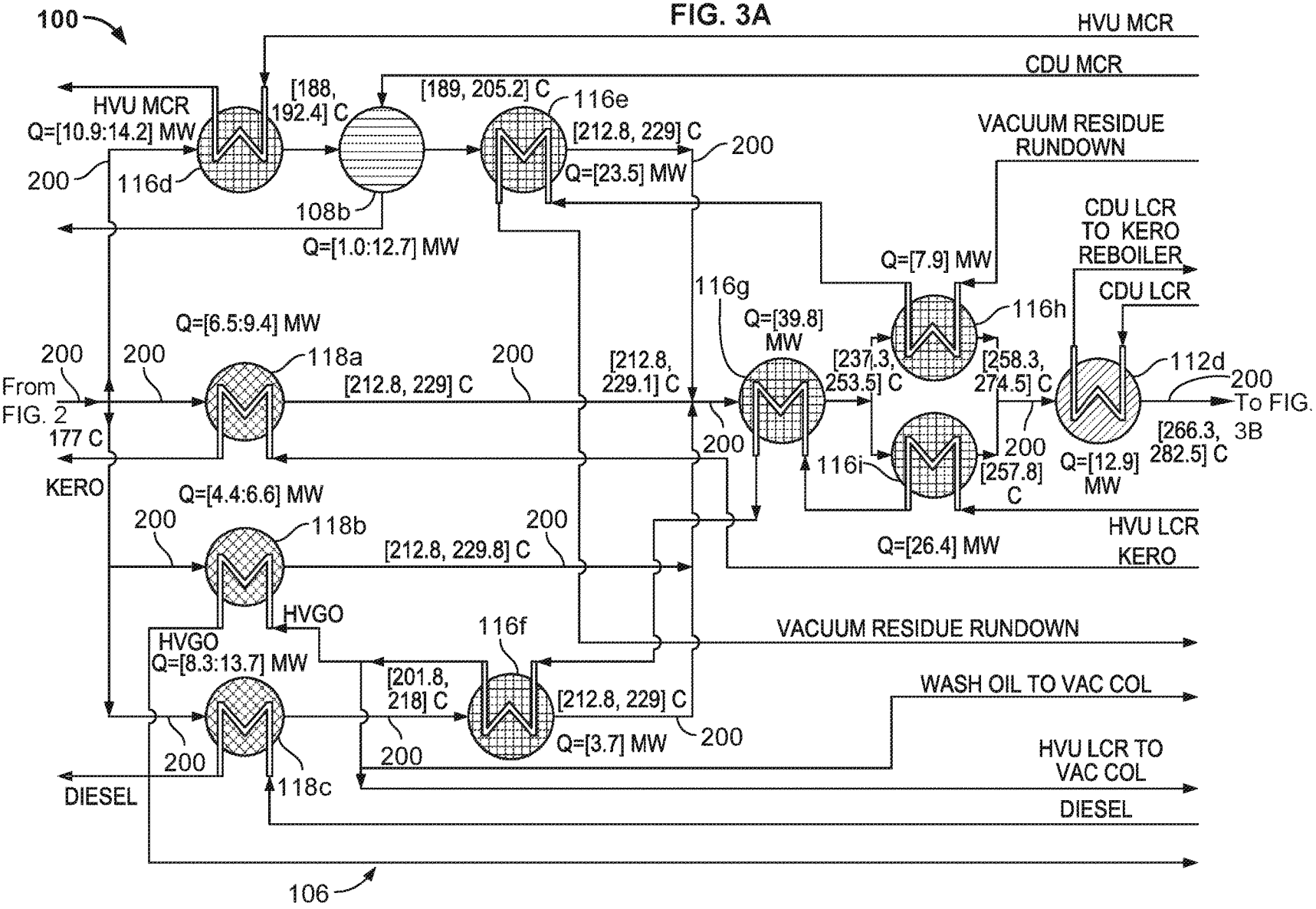
FIGS. 3A-3B are schematic illustrations of a crude oil stream flowing through one or more heat exchangers between flashing and a furnace in a refinery PHT.
Figure 3B:
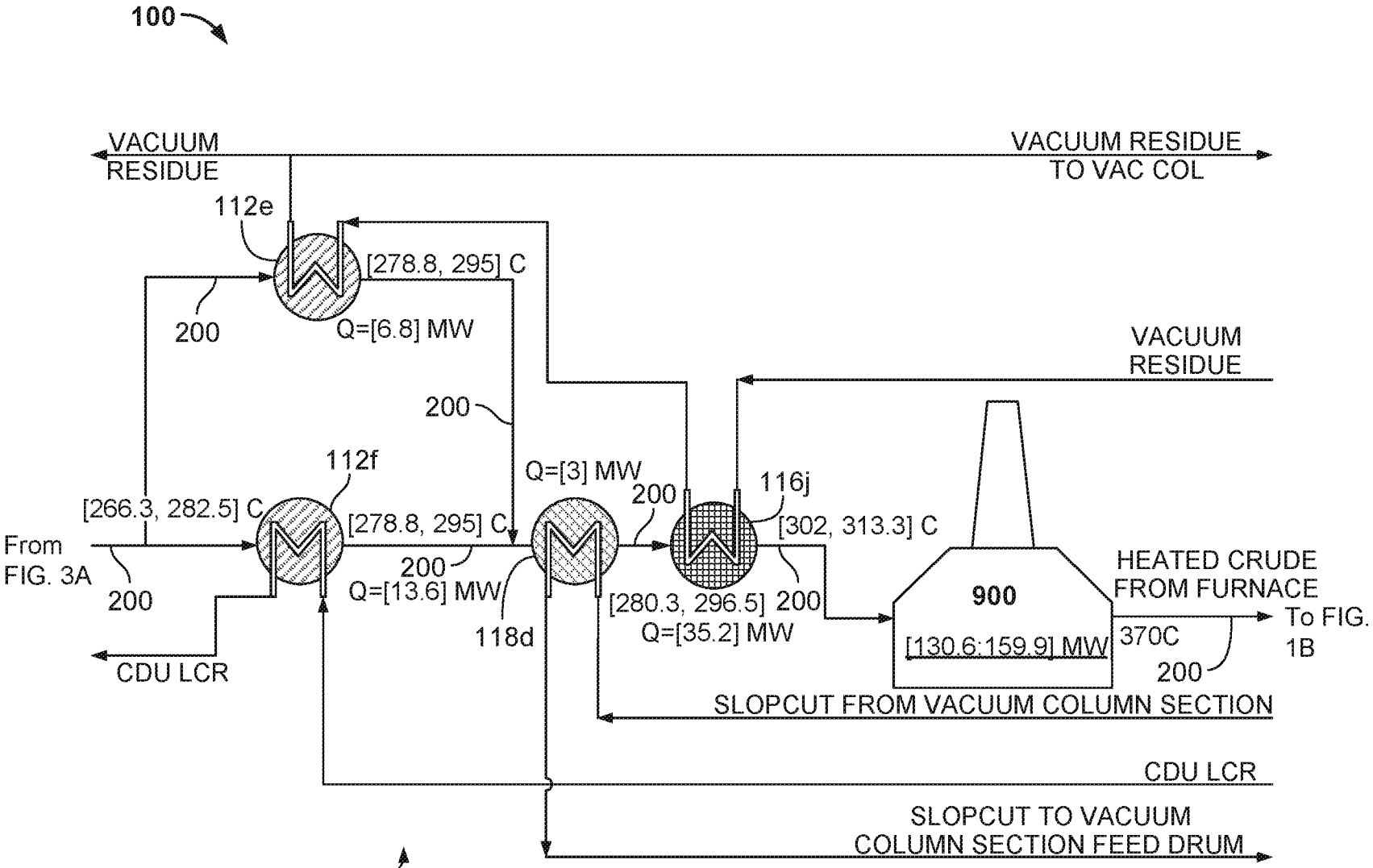

FIGS. 3A-3B are schematic illustrations of a crude oil stream flowing through one or more heat exchangers between flashing and a furnace in a third section 106 in the refinery PHT 100. As described previously, FIGS. 3A-3B illustrate the crude oil stream path 200 from the flash drum/tower to the furnace. The third section 106 of the PHT 100 includes a heat exchanger network including heat exchangers 116*d*, 108*b*, 116*e*, 118*a*, 118*b*, 118*c*, 116*f*, 116*g*, 116*h*, 116*i*, 112*d*, 112*e*, 112*f*, 118*d*, and 116*j*. In section 106, the crude oil stream 200 flows through a series of heat exchangers 116*d*, 108*b*, and 116*e*, which is in parallel with heat exchanger 118*a*, which is in parallel with heat exchanger 118*b*, which is also in parallel with a series of heat exchangers 118*c* and 116*f*. Then, the combined crude oil stream 200 flows through heat exchanger 116*g*. The crude oil stream 200 then splits and flows through heat exchangers 116*h* and 116*i* in parallel, before it is re-combined into a single stream again to flow through heat exchanger 112*d*. The crude oil stream 200 then splits again and flows through heat exchangers 112*e* and 112*f* in parallel, before it is combined once again into a single stream to flow through heat exchangers 118*d* and 116*j* prior to its introduction into furnace 900.

The crude oil stream 200 after the pre-flash drum in FIG. 3A is first split into four branches and heated from about 177° C. to about 213-229° C. using six hot streams; kerosene product in heat exchanger 118*a*; diesel product in heat exchanger 118*c*, heavy vacuum unit middle circulating reflux in heat exchanger 116*d*, vacuum residue in heat exchanger 116*e*, heavy vacuum unit lower circulating reflux in heat exchanger 116*f* and crude distillation unit middle circulating reflux stream in heat exchanger 108*b*, and heavy vacuum gas oil product (part of heavy vacuum unit middle circulating stream) in heat exchanger 118*b*. The crude oil stream 200 is then combined in one stream and heated up to about 254° C. in heat exchanger 116*g* using heavy vacuum unit lower circulating reflux out from heat exchanger 116*i*. The crude oil stream 200 is again split into two branches to be heated up to about 275° C. using vacuum residue product stream in heat exchanger 116*h*, and heavy vacuum lower circulating reflux stream in heat exchanger 116*i*. The crude oil stream 200, now joined again in one stream, is heated up to about 263-283° C. using crude distillation unit lower circulating reflux stream in heat exchanger 112*d*.

The thermal loads shown in FIG. 3A depict the thermal loads of the heat exchangers 116*d*, 118*a*, 118*b*, 118*c*, 108*b*, 116*e*, 116*f*, 116*g*, 116*h*, 116*i*, and 112*d* of about 11-14 MW, 6.5-9 MW, 4.4-6.6 MW, 8-14 MW, 1-13 MW, 23.5 MW, 3.7 MW, 40 MW, 8 MW, 26 MW, and 13 MW, respectively of the section 106 design lifetime between the initial start, at minimum approach temperature of 30° C., to a future stage where the original minimum approach temperature has been halved to 15° C.

Turning to FIG. 3B, the crude oil stream at about 266-283° C. is split into two streams to be heated up to about 279-295° C. using vacuum residue product stream out from 116*j* and crude distillation unit lower circulating stream in heat exchanger 112*e* and heat exchanger 112*f*, respectively. The crude stream 200 is then heated up to about 313° C. before the atmospheric distillation unit furnace using hot vacuum stream from column section feed drum and vacuum residue product stream in heat exchangers units 118*d* and 116*j*, respectively. The thermal loads shown in FIG. 3B depict the thermal loads of the heat exchangers 112*e*, 112*f*, 118*d*, and 116*j* of about 7 MW, 14 MW, 3 MW and 35 MW, respectively, of the section 106 design lifetime between the initial start, at minimum approach temperature of 30° C., to a future stage where the original minimum approach temperature has been halved to 15° C. The atmospheric crude distillation unit furnace duty in the same range of minimum approach temperature is about 130 MW to 160 MW.

The atmospheric crude furnace depicted in the PHT 100 may save more fossil fuel and more fuel-based greenhouse gas emissions upon the further manipulation of the heat exchangers surface areas within the described heat exchanger networks along the refinery lifetime that may reach 50 years. For instance, this PHT 100 can save more than 200 MM Btu/h and its associated greenhouse gas emissions for 50 years, which could not be captured or mitigated at all by the state-of-art crude distillation pre-heat designs for a crude oil refinery for 0.5 Million Barrel/day capacity; of medium or mixed grades crude oil. Taking into consideration that worldwide crude oil refining in the upcoming future is exceeding about 90 Million Barrel/day, the world wide fossil fuel saving and fuel-based-greenhouse gas emissions using this invention is significant.

Figure 4A:
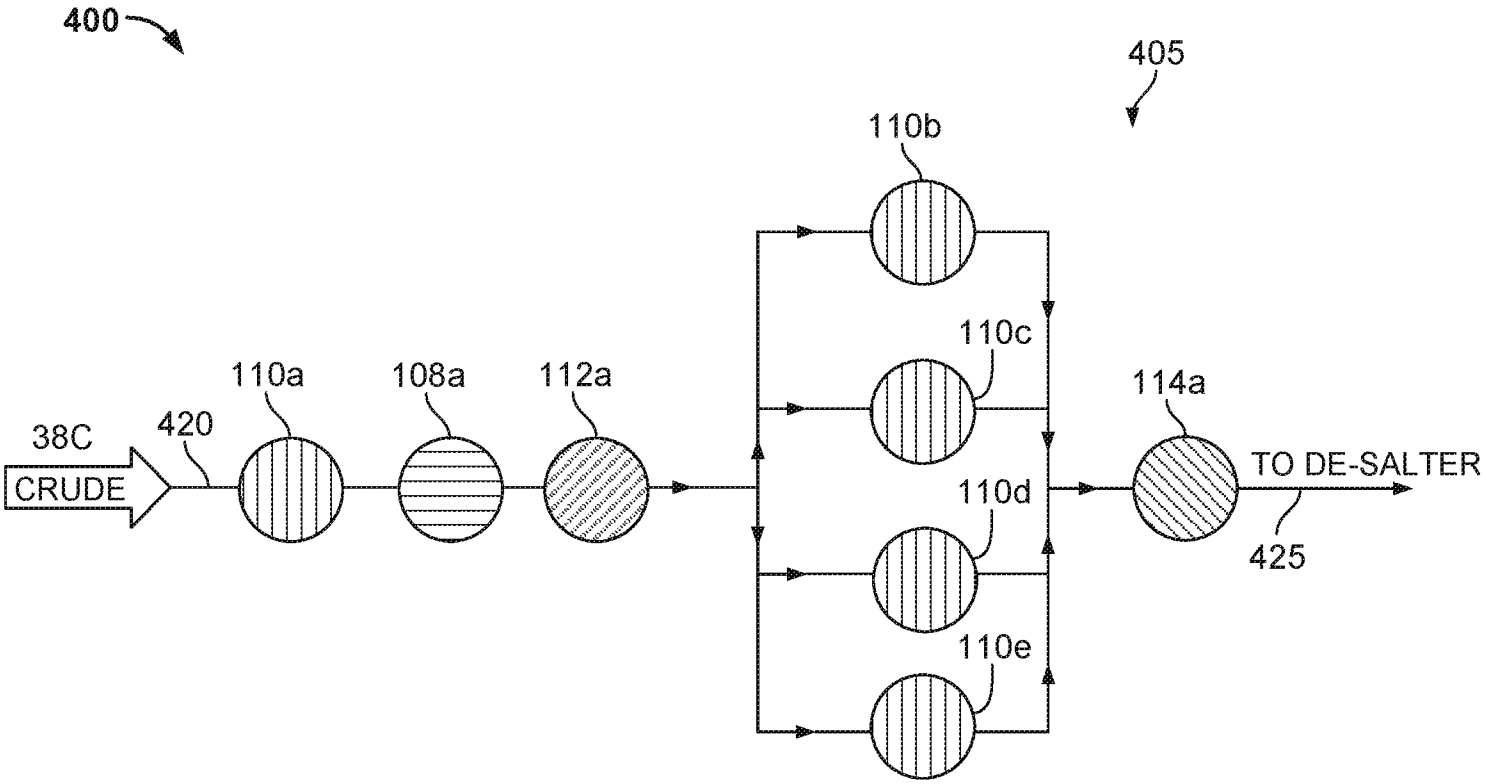
FIGS. 4A-4C are schematic illustrations of a heat exchanger system and heat exchanger sub-systems for a crude oil stream flowing in a refinery PHT.
Figure 4B:
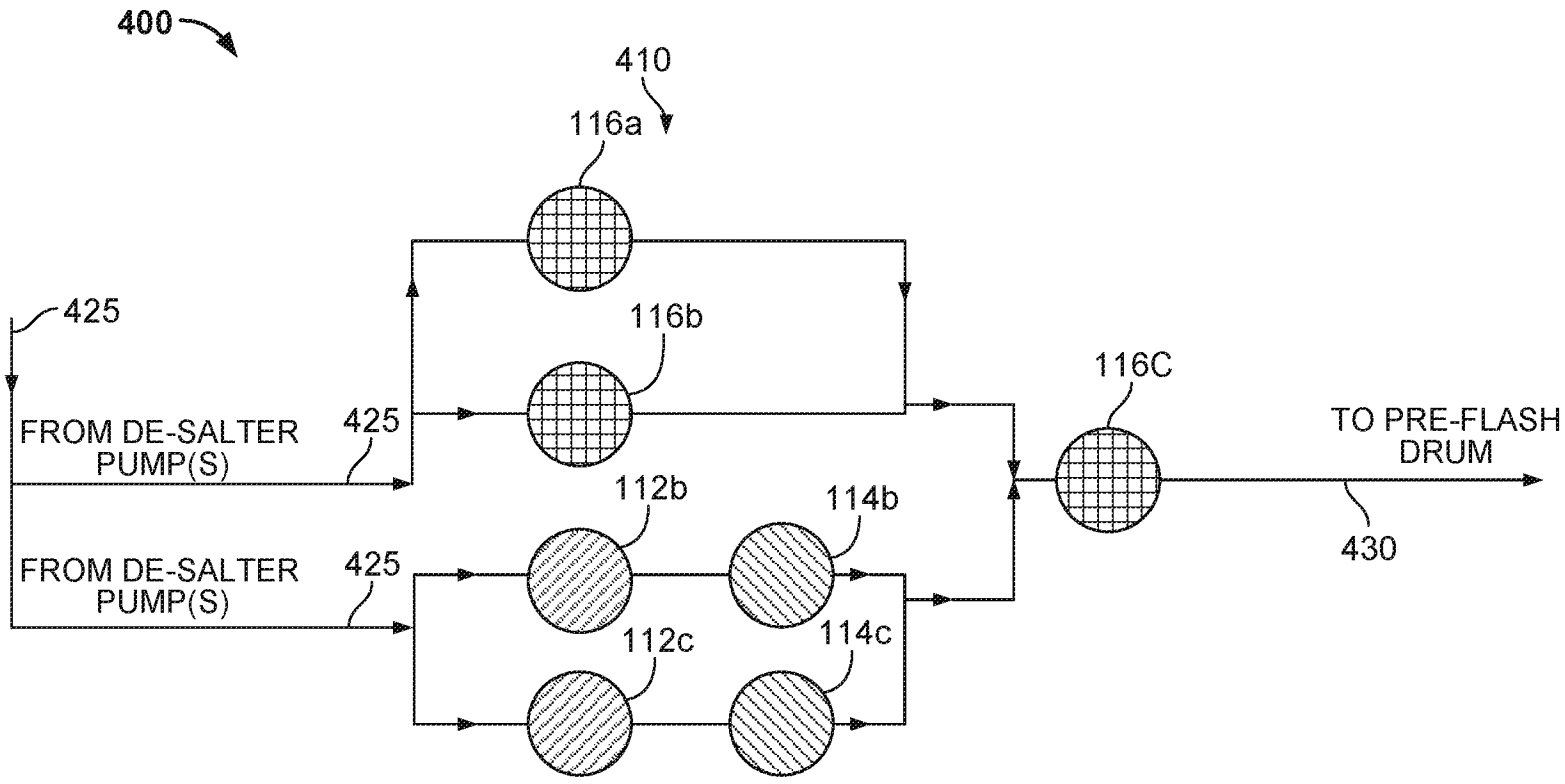
Figure 4C:
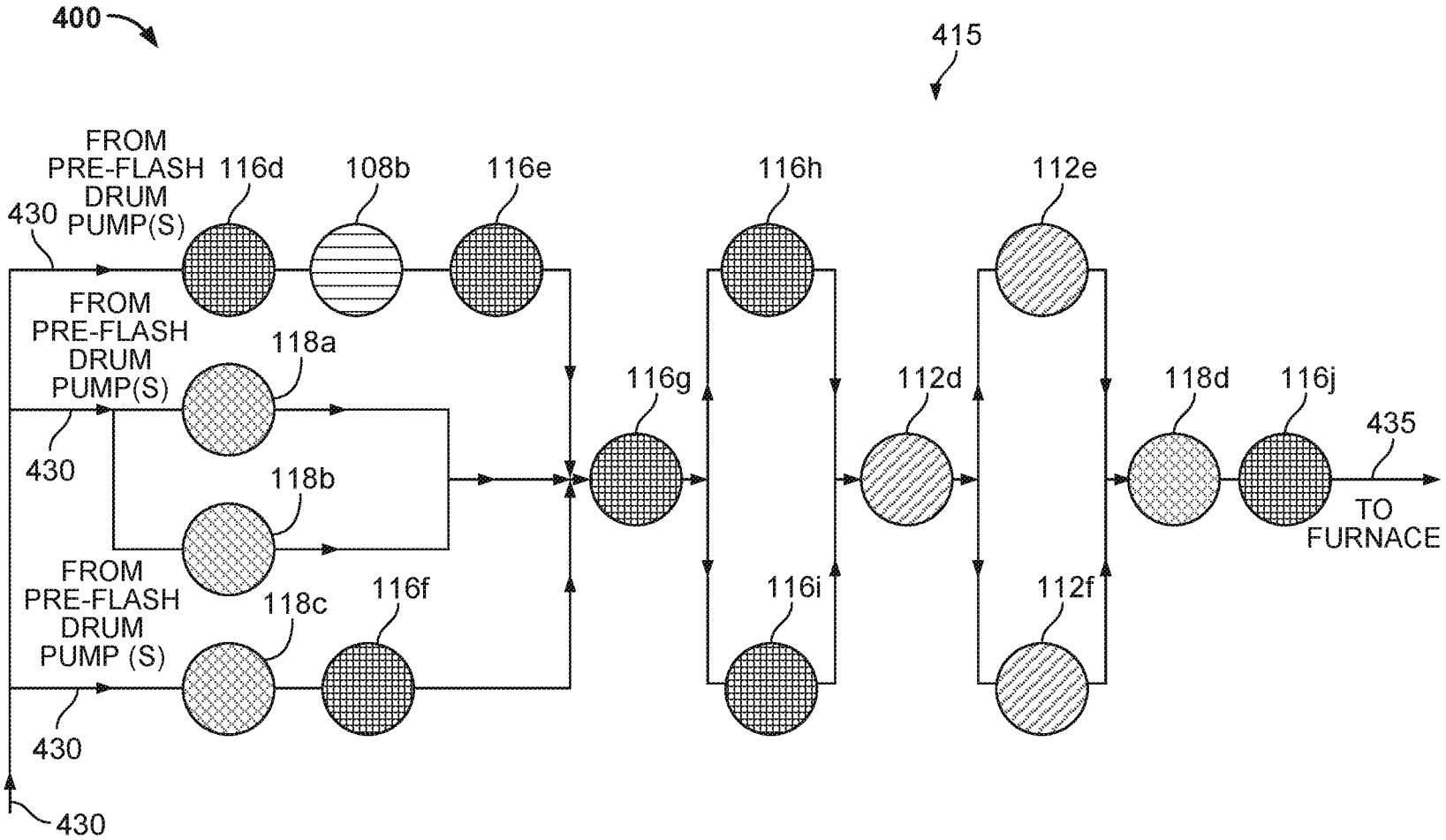

FIGS. 4A-4C are schematic illustrations of a heat exchanger system 400 and heat exchanger sub-systems for a crude oil stream flowing in a refinery PHT. Generally, these figures illustrated a simplified schematic that shows only the crude oil stream and heat exchangers from FIGS. 1A-1C, 2, and 3A-3B, through which the crude oil stream flows in the PHT 100 described previously. In FIGS. 4A-4C, the heat exchanger network 400 that is part of the PHT is split into three sections: 405, 410, and 415.

FIG. 4A shows section 405 of the heat exchanger network 400. In section 405 of the crude oil stream path, the crude oil stream 420 goes through three heat exchangers (110*a*, 108*a* and 112*a*) in series before the stream 420 gets divided into four portions in four heat exchangers (110*b*, 110*c*, 110*d*, and 110*e*). The crude oil stream 420 joins again in one stream and this crude oil stream 420 goes through one heat exchanger (114*a*) for heating up to the desalting temperature. The crude oil leaves section 405 as crude oil stream 425 to enter the section 410.

FIG. 4B shows section 410 of the heat exchanger network 400. The section 410 of the crude oil stream path starts after the de-salting of the crude oil where the crude oil stream 425 is split into two streams. The first crude oil stream branch goes through two heat exchangers (116*a* and 116*b*) in parallel arrangement before it joins the second branch; to go as one stream again through one heat exchanger (116*c*) to the pre-flash drum/tower. The second crude oil stream branch goes through two heat exchangers (112*b* and 114*b*) in parallel arrangement with another two heat exchangers (112*c* and 114*c*) in series arrangement. The second branch then joins the first branch as mentioned previously and exits section 410 as crude oil stream 430.

FIG. 4C shows section 415 of the heat exchanger network 400. The third section 415 of the crude path starts after the pre-flash drum/tower and consists of two parts. In some implementations, in the first part the crude oil stream 430 out of the pre-flash drum/tower is pumped (for example, using variable speed pump(s)) to enable velocity manipulation of the crude oil stream 430 in this section of the pre-heat train crude oil stream path to counterattack fouling acceleration due to high temperature matches between crude oil stream branches and products streams and pump around streams.

The crude oil stream 430 splits into three branches. The first branch goes through three heat exchangers (116*d*, 108*b*, and 116*e*) in a series arrangement before it joins again the other two branches to go into the second part of the section 415. The second branch goes through two heat exchangers (118*a* and 118*b*) in parallel arrangement. The third branch goes through another two heat exchangers (118*c* and 116*f*) but in a series arrangement.

The three branches are joined in one stream to go through one heat exchanger (116*g*). This heat exchanger and the heat exchangers downstream thereof may suffer accelerated fouling due to high temperature matches between the crude stream and products streams as mentioned previously. Fouling mitigation methods can be used, but in the described implementations, by-design mitigation may also be used in section 415 through three layers according to a level of fouling expected from using certain crude types. The first and permanent layer may be the one at the last heat exchanger in the PHT before the furnace (116*j*), where the variable speed pump can render an increase in the pressure/velocity that moves the fouling particulates from the earlier exchangers to the last one. This last heat exchanger (116*j*) may be designed with extra surface area (for example, using stand-by shell(s)) to increase a runtime before cleaning and allow the online cleaning methods. The second and third layers, which also use stand-by shells or plates, may be located in the parallel arrangement portion of this section 415, and may be utilized based upon the crude type.

After heat exchanger 116*g*, the crude oil stream 430 splits into two streams to go through parallel heat exchangers (116*h* and 116*i*), and then again rejoins into one stream 430 to go through a single heat exchanger (112*d*). Next, the crude oil stream 430 splits into two streams again to go through parallel heat exchangers (112*e* and 112*f*), and then again rejoins into one stream 430 to go through two heat exchangers in series (118*d* and 116*j*). The crude oil exits section 415 as crude oil stream 435 to the furnace.

As described previously, heat exchanger surface area may be adjusted (increased or decreased) over the life of the crude oil refinery PHT. By adjusting heat exchanger surface area of one or more heat exchangers in the PHT 100, the changing approach temperature may be accounted for, heat exchange efficiency may be improved, or the configuration of the PHT 100 may be adjusted while keeping the topology of the design static over the life of the PHT 100, or any combination thereof.

In some example implementations, an initial design of a particular heat exchanger in the PHT 100 may have a specified thermal duty (for example, heat transfer capacity), yet an adjustment to that specified thermal duty may also be known at the time of the initial design. For example, one or more of the heat exchangers shown in sections 102, 104, and 106 of the PHT 100 may have specified initial capacities, as well as pre-determined (that is, at the time of the initial design) adjustments to such specified initial capacities. For example, in some implementations, adjustments may be made according to Table 2.

In addition, in some implementations, due to, for example, an amount of increase or decrease of heat exchange surface area over lifetime operation, or initial thermal duty, certain heat exchangers may be designed as plate-and-frame heat exchangers (for example, rather than shell-and-tube or other type of heat exchanger). For instance, heat exchanger series 108, 112, and 118 may be designed as plate-and-frame heat exchangers.

TABLE 2

| Heat Exchanger Series | Surface Area Adjustment |
|---|---|
| 108a-b | Small thermal duty with gradual increase, as needed, over lifetime operation |
| 110a-e | No change to surface area over lifetime operation |
| 112a-f | Increase in surface area from about 100% up to 200% over lifetime operation |
| 114a-c | Reduction in surface area from about 13% up to 45% over lifetime operation |
| 116a-j | Increase in surface area from about 20% up to 90% over lifetime operation |
| 118a-d | Increase in surface area up to about 300% over lifetime operation |

In some implementations, the 108 series heat exchangers (108*a*-108*b*) are fixed in location of the PHT 100 from initial design throughout the lifetime operation (that is, fixed from the perspective of topology, configuration, and cold-hot stream-matching) but not fixed from the perspective of heat exchange surface area. Heat exchangers 108*a*-108*b* may have their respective total surface area increased from an initial design over time along the plant lifetime to enable the PHT 100 of the crude distillation plant to save more energy in the furnace in the future. The extra surface area can be accommodated in an initial heat exchanger unit plot plan to avoid any congestion in the future by keeping enough floor space for the future for these heat exchangers. The respective surface areas can be increased gradually upon each plant retrofit project to increase the PHT heat recovery capability to decrease the furnace fuel consumption. Advantageously, a crude oil refinery PHT designer and operators will know the extent of increases required in the future at the plant initial design time to reserve some floor space at certain designated places in the plant for the future.

In some implementations, the 110 series heat exchangers (110*a*-110*e*) are fixed in location of the PHT 100 from initial design throughout the lifetime operation (that is, fixed from the perspective of topology, configuration, and cold-hot stream-matching) as well as fixed from the perspective of heat exchange surface area along the plant lifetime regardless of the amount of future fuel reduction in the furnace. In other words both the configuration and the surface areas of these heat exchangers may be fixed along the plant lifetime even if with retrofits to the PHT 100 to save more energy in the future.

In some implementations, the 112 series heat exchangers (112*a*-112*f*) are fixed in location of the PHT 100 from initial design throughout the lifetime operation (that is, fixed from the perspective of topology, configuration, and cold-hot stream-matching) but not fixed from the perspective of heat exchange surface area. Heat exchangers 112*a*-112*f* may have their respective total surface area increased from an initial design over time along the plant lifetime to enable the PHT 100 of the crude distillation plant to save more energy in the furnace in the future. The extra surface area can be accommodated in an initial heat exchanger unit plot plan to avoid any congestion in the future by keeping enough floor space for the future for these heat exchangers. The respective surface areas can be increased gradually upon each plant retrofit project to increase the PHT heat recovery capability to decrease the furnace fuel consumption. Advantageously, a crude oil refinery PHT designer and operators will know the extent of increases required in the future at the plant initial design time to reserve some floor space at certain designated places in the plant for the future.

The need for increase in the surface areas of these heat exchangers may differ from one unit to another. For instance, a particular 112 series heat exchanger may need a 100% increase in surface area while another particular 112 series heat exchanger may need 200% (or more) increase in the surface area. In some implementations, the described percentages may be a minimum surface area that is to be increased along the plant lifetime and the maximum surface area that needs to be increased for another unit among the 112 series heat exchangers For example, the 100% increase in a particular 112 series heat exchanger may not have to be increased during a single retrofit project, but instead, may be increased gradually upon each plant retrofit project to increase the PHT heat recovery capability to decrease the furnace fuel consumption.

In some implementations, the 114 series heat exchangers (114*a*-114*c*) are fixed in location of the PHT 100 from initial design throughout the lifetime operation (that is, fixed from the perspective of topology, configuration, and cold-hot stream-matching) but not fixed from the perspective of heat exchange surface area. These 114 series heat exchangers units may not need their respective initial total surface area to enable the PHT 100 of the crude distillation plant to save more energy in the furnace in the future. The extra surface area can be, for example, bypassed or some of the tubes or the plates inside the heat exchanger unit removed, from the unit in order to achieve a heat exchange surface area reduction. The need for decrease in the surface areas of these heat exchangers may differ from one unit to another. For example, one unit may need a 13% decrease in surface area while another unit may need 45% decrease in the heat exchange surface area. Advantageously, a crude oil refinery PHT designer and operators will know the extent of decreases required in the future at the plant initial design time to reserve some floor space at certain designated places in the plant for the future.

In some implementations, the described percentages may be a minimum surface area that is to be decreased along the plant lifetime and the maximum surface area that needs to be increased for another unit among the 114 series heat exchangers For example, the 45% decrease in a particular 112 series heat exchanger may not have to be decreased during a single retrofit project, but instead, may be decreased gradually upon each plant retrofit project to increase the PHT heat recovery capability to decrease the furnace fuel consumption.

In some implementations, the 116 series heat exchangers (116*a*-116*j*) are fixed in location of the PHT 100 from initial design throughout the lifetime operation (that is, fixed from the perspective of topology, configuration, and cold-hot stream-matching) but not fixed from the perspective of heat exchange surface area. Heat exchangers 116*a*-116*j* may have their respective total surface area increased from an initial design over time along the plant lifetime to enable the PHT 100 of the crude distillation plant to save more energy in the furnace in the future. The extra surface area can be accommodated in an initial heat exchanger unit plot plan to avoid any congestion in the future by keeping enough floor space for the future for these heat exchangers. The respective surface areas can be increased gradually upon each plant retrofit project to increase the PHT heat recovery capability to decrease the furnace fuel consumption. Advantageously, a crude oil refinery PHT designer and operators will know the extent of increases required in the future at the plant initial design time to reserve some floor space at certain designated places in the plant for the future.

The need for increase in the surface areas of these heat exchangers may differ from one unit to another. For instance, a particular 116 series heat exchanger may need a 20% increase in surface area while another particular 116 series heat exchanger may need 90% (or more) increase in the surface area. In some implementations, the described percentages may be a minimum surface area that is to be increased along the plant lifetime and the maximum surface area that needs to be increased for another unit among the 116 series heat exchangers For example, the 90% increase in a particular 116 series heat exchanger may not have to be increased during a single retrofit project, but instead, may be increased gradually upon each plant retrofit project to increase the PHT heat recovery capability to decrease the furnace fuel consumption.

In some implementations, the 118 series heat exchangers (118*a*-118*d*), are fixed in location of the PHT 100 from initial design throughout the lifetime operation (that is, fixed from the perspective of topology, configuration, and cold-hot stream-matching) but not fixed from the perspective of heat exchange surface area. Heat exchangers 118*a*-118*d* may have their respective total surface area increased from an initial design over time along the plant lifetime to enable the PHT 100 of the crude distillation plant to save more energy in the furnace in the future. The extra surface area can be accommodated in an initial heat exchanger unit plot plan to avoid any congestion in the future by keeping enough floor space for the future for these heat exchangers. The respective surface areas can be increased gradually upon each plant retrofit project to increase the PHT heat recovery capability to decrease the furnace fuel consumption. Advantageously, a crude oil refinery PHT designer and operators will know the extent of increases required in the future at the plant initial design time to reserve some floor space at certain designated places in the plant for the future.

The need for increase in the surface areas of these heat exchangers may differ from one unit to another. For instance, a particular 118 series heat exchanger may need a 200% increase in surface area while another particular 118 series heat exchanger may need 300% (or more) increase in the surface area. In some implementations, the described percentages may be a minimum surface area that is to be increased along the plant lifetime and the maximum surface area that needs to be increased for another unit among the 118 series heat exchangers For example, the 300% increase in a particular 118 series heat exchanger may not have to be increased during a single retrofit project, but instead, may be increased gradually upon each plant retrofit project to increase the PHT heat recovery capability to decrease the furnace fuel consumption.

The decrease or increase in a heat exchanger surface area in the PHT 100 fixed topology is due to a new heat transfer thermal duty (Q) required from the unit upon using an adjusted (for example, lower) value for a minimum approach temperature (for example, the difference in an entering temperature of a hot fluid and a leaving temperature of the crude oil stream 200). Further, a new waste heat recovery from the particular heat exchanger results in different logarithmic mean temperature difference, LMTD, governed by:

$$A = \frac{Q}{U * LMTD},$$

where A is the heat exchange surface area of the heat exchanger in square meters, Q is the thermal duty in MW, U is the heat transfer coefficient in watts per square meters per Kelvin, and LMTD is the log mean temperature difference in Kelvin. The LMTD can be expressed as:

$$LMTD = \frac{\Delta T_A - \Delta T_B}{\ln\left(\frac{\Delta T_A}{\Delta T_B}\right)},$$

where $\Delta T_A$ is a difference in temperature between the two fluid stream at a first end, "A", of the heat exchanger, and $\Delta T_B$ is a difference in temperature between the two fluid stream at a second end, "B", of the heat exchanger. These temperature differences correspond, for example, to the particular minimum approach temperature (for example, from 30° C. down to 15° C.) utilized in the PHT 100 at a particular point of operation within the total lifetime operation.

Particular implementations of the subject matter have been described. Other implementations are within the scope of the following claims.

What is claimed is:

1. A refining system, comprising:

a hydrocarbon stream pipeline system that extends through the refining system and is configured to carry a stream of hydrocarbons from an inlet of the refining system;

a plurality of heat exchangers positioned in the hydrocarbon stream pipeline system, each of the plurality of heat exchangers comprising an adjustable heat exchange surface area, the plurality of heat exchangers comprising:

a first set of heat exchangers positioned in the hydrocarbon stream pipeline system in a first reaction or separation section of the refining system, the first reaction or separation section comprising a portion of the refining system between the inlet of the refining system and a second reaction or separation section of the refining system, the first set of heat exchangers comprising a first portion of heat exchangers of the first set of heat exchangers in a series arrangement of heat exchangers and a second portion of heat exchangers in the first set of heat exchangers in a parallel arrangement of heat exchangers, and a second set of heat exchangers positioned in the hydrocarbon stream pipeline system in the second reaction or separation section of the refining system, the second reaction or separation section comprising a portion of the refining system after the first reaction or separation section of the refining system and before a third separation section of the refining system, the second set of heat exchangers comprising a first portion of heat exchangers of the second set of heat exchangers in a series arrangement of heat exchangers and a second portion of heat exchangers in the second set of heat exchangers in a parallel arrangement of heat exchangers; and a control system configured to actuate a first plurality of control valves to selectively thermally couple the hydrocarbon stream to a plurality of heat sources in the first reaction or separation section of the refining system within the first set of heat exchangers, the control system also configured to actuate a second plurality of control valves to selectively thermally couple the hydrocarbon stream to a plurality of heat sources in the second reaction or separation section of the refining system within the second set of heat exchangers.

2. The refining system of claim 1, wherein at least a portion of the plurality of heat exchangers are shell-and-tube heat exchangers or plate-and-frame heat exchangers.

3. The refining system of claim 1, wherein:

a first lot of the plurality of heat exchangers comprises a heat exchange surface area adjustable from an initial design heat exchange surface area to an adjusted design heat exchange surface area that is between 100% and 200% greater than the initial design heat exchange surface area;

a second lot of the plurality of heat exchangers comprises a heat exchange surface area adjustable from an initial design heat exchange surface area to an adjusted design heat exchange surface area that is between 13% and 45% less than the initial design heat exchange surface area;

a third lot of the plurality of heat exchangers comprises a heat exchange surface area adjustable from an initial design heat exchange surface area to an adjusted design heat exchange surface area that is between 20% and 90% greater than the initial design heat exchange surface area; and a fourth lot of the plurality of heat exchangers comprises a heat exchange surface area adjustable from an initial design heat exchange surface area to an adjusted design heat exchange surface area that is up to 300% greater than the initial design heat exchange surface area.

4. The refining system of claim 1, wherein each of the plurality of heat exchangers comprises a minimum approach temperature that comprises a difference between an entering temperature of a hot fluid and a leaving temperature of the hydrocarbon stream.

5. The refining system of claim 4, wherein the minimum approach temperature is adjustable between about 30° C. and 15° C.

6. The refining system of claim 1, wherein the first portion of heat exchangers of the first set of heat exchangers in the series arrangement of heat exchangers comprises at least three heat exchangers in series, and the second portion of heat exchangers in the first set of heat exchangers in the parallel arrangement of heat exchangers comprises at least four heat exchangers in parallel.

7. The refining system of claim 1, wherein the first portion of heat exchangers of the second set of heat exchangers in the series arrangement of heat exchangers comprises at least two heat exchangers in series, and the second portion of heat exchangers in the second set of heat exchangers in the parallel arrangement of heat exchangers comprises at least six heat exchangers in parallel.

8. The refining system of claim 6, wherein the first portion of heat exchangers of the second set of heat exchangers in the series arrangement of heat exchangers comprises at least two heat exchangers in series, and the second portion of heat exchangers in the second set of heat exchangers in the parallel arrangement of heat exchangers comprises at least six heat exchangers in parallel.

9. The refining system of claim 1, wherein the plurality of heat exchangers further comprise a third set of heat exchangers positioned in the hydrocarbon stream pipeline system in the third separation section of the refining system, the third separation section comprising a portion of the refining system after the second reaction or separation section of the refining system and before an outlet of the refining system, the third set of heat exchangers comprising a first portion of heat exchangers of the third set of heat exchangers in a series arrangement of heat exchangers and a second portion of heat exchangers in the third set of heat exchangers in a parallel arrangement of heat exchangers.

10. The refining system of claim 9, wherein the control system is further configured to actuate a third plurality of control valves to selectively thermally couple the hydrocarbon stream with a plurality of heat sources in the third separation section of the refining system within the third set of heat exchangers.

11. The refining system of claim 9, wherein the first portion of heat exchangers of the third set of heat exchangers in the series arrangement of heat exchangers comprises at least seven heat exchangers in series, and the second portion of heat exchangers in the third set of heat exchangers in the parallel arrangement of heat exchangers comprises at least eight heat exchangers in parallel.

12. A hydrocarbon refining method, comprising:

circulating a hydrocarbon stream through a hydrocarbon stream pipeline system that extends through refining system from an inlet of the refining system;

circulating the hydrocarbon stream through a plurality of heat exchangers positioned in the hydrocarbon stream pipeline system, each of the plurality of heat exchangers comprising an adjustable heat exchange surface area, the plurality of heat exchangers comprising:

a first set of heat exchangers positioned in the hydrocarbon stream pipeline system in a first reaction or separation section of the refining system, the first reaction or separation section comprising a portion of the refining system between the inlet of the refining system and a second reaction or separation section of the refining system, the first set of heat exchangers comprising a first portion of heat exchangers of the first set of heat exchangers in a series arrangement of heat exchangers and a second portion of heat exchangers in the first set of heat exchangers in a parallel arrangement of heat exchangers, and a second set of heat exchangers positioned in the hydrocarbon stream pipeline system in the second reaction or separation section of the refining system, the second reaction or separation section comprising a portion of the refining system after the first reaction or separation section of the refining system and before a third separation section of the refining system, the second set of heat exchangers comprising a first portion of heat exchangers of the second set of heat exchangers in a series arrangement of heat exchangers and a second portion of heat exchangers in the second set of heat exchangers in a parallel arrangement of heat exchangers;

actuating, with a control system, a first plurality of control valves to selectively thermally couple the hydrocarbon stream to a plurality of heat sources in the first reaction or separation section of the refining system within the first set of heat exchangers;

actuating, with the control system, a second plurality of control valves to selectively thermally couple the hydrocarbon stream with a plurality of heat sources in the second reaction or separation section of the refining system within the second set of heat exchangers; and heating the hydrocarbon stream through the plurality of heat exchangers.

13. The hydrocarbon refining method of claim 12, wherein at least a portion of the plurality of heat exchangers are shell-and-tube heat exchangers or plate-and-frame heat exchangers.

14. The hydrocarbon refining method of claim 12, wherein:

a first lot of the plurality of heat exchangers comprises a heat exchange surface area adjustable from an initial design heat exchange surface area to an adjusted design heat exchange surface area that is between 100% and 200% greater than the initial design heat exchange surface area;

a second lot of the plurality of heat exchangers comprises a heat exchange surface area adjustable from an initial design heat exchange surface area to an adjusted design heat exchange surface area that is between 13% and 45% less than the initial design heat exchange surface area;

a third lot of the plurality of heat exchangers comprises a heat exchange surface area adjustable from an initial design heat exchange surface area to an adjusted design heat exchange surface area that is between 20% and 90% greater than the initial design heat exchange surface area; and a fourth lot of the plurality of heat exchangers comprises a heat exchange surface area adjustable from an initial design heat exchange surface area to an adjusted design heat exchange surface area that is up to 300% greater than the initial design heat exchange surface area.

15. The hydrocarbon refining method of claim 12, wherein each of the plurality of heat exchangers comprises a minimum approach temperature that comprises a difference between an entering temperature of a hot fluid and a leaving temperature of the hydrocarbon stream.

16. The hydrocarbon refining method of claim 15, wherein the minimum approach temperature is adjustable between about 30° C. and 15° C.

17. The hydrocarbon refining method of claim 12, wherein the first portion of heat exchangers of the first set of heat exchangers in the series arrangement of heat exchangers comprises at least three heat exchangers in series, and the second portion of heat exchangers in the first set of heat exchangers in the parallel arrangement of heat exchangers comprises at least four heat exchangers in parallel.

18. The hydrocarbon refining method of claim 12, wherein the first portion of heat exchangers of the second set of heat exchangers in the series arrangement of heat exchangers comprises at least two heat exchangers in series, and the second portion of heat exchangers in the second set of heat exchangers in the parallel arrangement of heat exchangers comprises at least six heat exchangers in parallel.

19. The hydrocarbon refining method of claim 17, wherein the first portion of heat exchangers of the second set of heat exchangers in the series arrangement of heat exchangers comprises at least two heat exchangers in series, and the second portion of heat exchangers in the second set of heat exchangers in the parallel arrangement of heat exchangers comprises at least six heat exchangers in parallel.

20. The hydrocarbon refining method of claim 12, wherein the plurality of heat exchangers further comprise a third set of heat exchangers positioned in the hydrocarbon stream pipeline system in the third separation section of the refining system, the third separation section comprising a portion of the refining system after the second reaction or separation section of the refining system and before an outlet of the refining system, the third set of heat exchangers comprising a first portion of heat exchangers of the third set of heat exchangers in a series arrangement of heat exchangers and a second portion of heat exchangers in the third set of heat exchangers in a parallel arrangement of heat exchangers.

21. The hydrocarbon refining method of claim 20, further comprising actuating, with the control system, a third plurality of control valves to selectively thermally couple the hydrocarbon stream to a plurality of heat sources in the third separation section of the refining system within the third set of heat exchangers.

22. The hydrocarbon refining method of claim 20, wherein the first portion of heat exchangers of the third set of heat exchangers in the series arrangement of heat exchangers comprises at least seven heat exchangers in series, and the second portion of heat exchangers in the third set of heat exchangers in the parallel arrangement of heat exchangers comprises at least eight heat exchangers in parallel.

23. A refining system, comprising:

a hydrocarbon stream pipeline system that extends through the refining system and is configured to carry a stream of hydrocarbons from an inlet of the refining system;

a plurality of heat exchangers positioned in the hydrocarbon stream pipeline system, the plurality of heat exchangers comprising:

a first set of heat exchangers positioned in the hydrocarbon stream pipeline system in a first reaction or separation section of the refining system, the first reaction or separation section comprising a portion of the refining system between the inlet of the refining system and a second reaction or separation section of the refining system, the first set of heat exchangers comprising a first portion of heat exchangers of the first set of heat exchangers in a series arrangement of heat exchangers and a second portion of heat exchangers in the first set of heat exchangers in a parallel arrangement of heat exchangers, and a second set of heat exchangers positioned in the hydrocarbon stream pipeline system in the second reaction or separation section of the refining system, the second reaction or separation section comprising a portion of the refining system after the first reaction or separation section of the refining system and before a third separation section of the refining system, the second set of heat exchangers comprising a first portion of heat exchangers of the second set of heat exchangers in a series arrangement of heat exchangers and a second portion of heat exchangers in the second set of heat exchangers in a parallel arrangement of heat exchangers; and a control system configured to actuate a first plurality of control valves to selectively thermally couple the hydrocarbon stream to a plurality of heat sources in the first reaction or separation section of the refining system within the first set of heat exchangers, the control system also configured to actuate a second plurality of control valves to selectively thermally couple the hydrocarbon stream to a plurality of heat sources in the second reaction or separation section of the refining system within the second set of heat exchangers, wherein:

a first lot of the plurality of heat exchangers comprises a heat exchange surface area adjustable from an initial design heat exchange surface area to an adjusted design heat exchange surface area that is between 100% and 200% greater than the initial design heat exchange surface area;

a second lot of the plurality of heat exchangers comprises a heat exchange surface area adjustable from an initial design heat exchange surface area to an adjusted design heat exchange surface area that is between 13% and 45% less than the initial design heat exchange surface area;

a third lot of the plurality of heat exchangers comprises a heat exchange surface area adjustable from an initial design heat exchange surface area to an adjusted design heat exchange surface area that is between 20% and 90% greater than the initial design heat exchange surface area; and a fourth lot of the plurality of heat exchangers comprises a heat exchange surface area adjustable from an initial design heat exchange surface area to an adjusted design heat exchange surface area that is up to 300% greater than the initial design heat exchange surface area.

24. A refining system, comprising:

a hydrocarbon stream pipeline system that extends through the refining system and is configured to carry a stream of hydrocarbons from an inlet of the refining system;

a plurality of heat exchangers positioned in the hydrocarbon stream pipeline system, the plurality of heat exchangers comprising:

a first set of heat exchangers positioned in the hydrocarbon stream pipeline system in a first reaction or separation section of the refining system, the first reaction or separation section comprising a portion of the refining system between the inlet of the refining system and a second reaction or separation section of the refining system, the first set of heat exchangers comprising a first portion of heat exchangers of the first set of heat exchangers in a series arrangement of heat exchangers and a second portion of heat exchangers in the first set of heat exchangers in a parallel arrangement of heat exchangers, the first portion of heat exchangers of the first set of heat exchangers in the series arrangement of heat exchangers comprising at least three heat exchangers in series, and the second portion of heat exchangers in the first set of heat exchangers in the parallel arrangement of heat exchangers comprising at least four heat exchangers in parallel, and a second set of heat exchangers positioned in the hydrocarbon stream pipeline system in the second reaction or separation section of the refining system, the second reaction or separation section comprising a portion of the refining system after the first reaction or separation section of the refining system and before a third separation section of the refining system, the second set of heat exchangers comprising a first portion of heat exchangers of the second set of heat exchangers in a series arrangement of heat exchangers and a second portion of heat exchangers in the second set of heat exchangers in a parallel arrangement of heat exchangers; and a control system configured to actuate a first plurality of control valves to selectively thermally couple the hydrocarbon stream to a plurality of heat sources in the first reaction or separation section of the refining system within the first set of heat exchangers, the control system also configured to actuate a second plurality of control valves to selectively thermally couple the hydrocarbon stream to a plurality of heat sources in the second reaction or separation section of the refining system within the second set of heat exchangers.

25. A refining system, comprising:

a hydrocarbon stream pipeline system that extends through the refining system and is configured to carry a stream of hydrocarbons from an inlet of the refining system;

a plurality of heat exchangers positioned in the hydrocarbon stream pipeline system, the plurality of heat exchangers comprising:

a first set of heat exchangers positioned in the hydrocarbon stream pipeline system in a first reaction or separation section of the refining system, the first reaction or separation section comprising a portion of the refining system between the inlet of the refining system and a second reaction or separation section of the refining system, the first set of heat exchangers comprising a first portion of heat exchangers of the first set of heat exchangers in a series arrangement of heat exchangers and a second portion of heat exchangers in the first set of heat exchangers in a parallel arrangement of heat exchangers, and a second set of heat exchangers positioned in the hydrocarbon stream pipeline system in the second reaction or separation section of the refining system, the second reaction or separation section comprising a portion of the refining system after the first reaction or separation section of the refining system and before a third separation section of the refining system, the second set of heat exchangers comprising a first portion of heat exchangers of the second set of heat exchangers in a series arrangement of heat exchangers and a second portion of heat exchangers in the second set of heat exchangers in a parallel arrangement of heat exchangers, the first portion of heat exchangers of the second set of heat exchangers in the series arrangement of heat exchangers comprising at least two heat exchangers in series, and the second portion of heat exchangers in the second set of heat exchangers in the parallel arrangement of heat exchangers comprising at least six heat exchangers in parallel; and a control system configured to actuate a first plurality of control valves to selectively thermally couple the hydrocarbon stream to a plurality of heat sources in the first reaction or separation section of the refining system within the first set of heat exchangers, the control system also configured to actuate a second plurality of control valves to selectively thermally couple the hydrocarbon stream to a plurality of heat sources in the second reaction or separation section of the refining system within the second set of heat exchangers.

26. A refining system, comprising:

a hydrocarbon stream pipeline system that extends through the refining system and is configured to carry a stream of hydrocarbons from an inlet of the refining system;

a plurality of heat exchangers positioned in the hydrocarbon stream pipeline system, the plurality of heat exchangers comprising:

a first set of heat exchangers positioned in the hydrocarbon stream pipeline system in a first reaction or separation section of the refining system, the first reaction or separation section comprising a portion of the refining system between the inlet of the refining system and a second reaction or separation section of the refining system, the first set of heat exchangers comprising a first portion of heat exchangers of the first set of heat exchangers in a series arrangement of heat exchangers and a second portion of heat exchangers in the first set of heat exchangers in a parallel arrangement of heat exchangers, a second set of heat exchangers positioned in the hydrocarbon stream pipeline system in the second reaction or separation section of the refining system, the second reaction or separation section comprising a portion of the refining system after the first reaction or separation section of the refining system and before a third separation section of the refining system, the second set of heat exchangers comprising a first portion of heat exchangers of the second set of heat exchangers in a series arrangement of heat exchangers and a second portion of heat exchangers in the second set of heat exchangers in a parallel arrangement of heat exchangers, and a third set of heat exchangers positioned in the hydrocarbon stream pipeline system in the third separation section of the refining system, the third separation section comprising a portion of the refining system after the second reaction or separation section of the refining system and before an outlet of the refining system, the third set of heat exchangers comprising a first portion of heat exchangers of the third set of heat exchangers in a series arrangement of heat exchangers and a second portion of heat exchangers in the third set of heat exchangers in a parallel arrangement of heat exchangers; and a control system configured to actuate a first plurality of control valves to selectively thermally couple the hydrocarbon stream to a plurality of heat sources in the first reaction or separation section of the refining system within the first set of heat exchangers, the control system also configured to actuate a second plurality of control valves to selectively thermally couple the hydrocarbon stream to a plurality of heat sources in the second reaction or separation section of the refining system within the second set of heat exchangers.

27. A hydrocarbon refining method, comprising:

circulating a hydrocarbon stream through a hydrocarbon stream pipeline system that extends through refining system from an inlet of the refining system;

circulating the hydrocarbon stream through a plurality of heat exchangers positioned in the hydrocarbon stream pipeline system, the plurality of heat exchangers comprising:

a first set of heat exchangers positioned in the hydrocarbon stream pipeline system in a first reaction or separation section of the refining system, the first reaction or separation section comprising a portion of the refining system between the inlet of the refining system and a second reaction or separation section of the refining system, the first set of heat exchangers comprising a first portion of heat exchangers of the first set of heat exchangers in a series arrangement of heat exchangers and a second portion of heat exchangers in the first set of heat exchangers in a parallel arrangement of heat exchangers, and a second set of heat exchangers positioned in the hydrocarbon stream pipeline system in the second reaction or separation section of the refining system, the second reaction or separation section comprising a portion of the refining system after the first reaction or separation section of the refining system and before a third separation section of the refining system, the second set of heat exchangers comprising a first portion of heat exchangers of the second set of heat exchangers in a series arrangement of heat exchangers and a second portion of heat exchangers in the second set of heat exchangers in a parallel arrangement of heat exchangers;

actuating, with a control system, a first plurality of control valves to selectively thermally couple the hydrocarbon stream to a plurality of heat sources in the first reaction or separation section of the refining system within the first set of heat exchangers;

actuating, with the control system, a second plurality of control valves to selectively thermally couple the hydrocarbon stream with a plurality of heat sources in the second reaction or separation section of the refining system within the second set of heat exchangers; and heating the hydrocarbon stream through the plurality of heat exchangers, wherein:

a first lot of the plurality of heat exchangers comprises a heat exchange surface area adjustable from an initial design heat exchange surface area to an adjusted design heat exchange surface area that is between 100% and 200% greater than the initial design heat exchange surface area;

a second lot of the plurality of heat exchangers comprises a heat exchange surface area adjustable from an initial design heat exchange surface area to an adjusted design heat exchange surface area that is between 13% and 45% less than the initial design heat exchange surface area;

a third lot of the plurality of heat exchangers comprises a heat exchange surface area adjustable from an initial design heat exchange surface area to an adjusted design heat exchange surface area that is between 20% and 90% greater than the initial design heat exchange surface area; and a fourth lot of the plurality of heat exchangers comprises a heat exchange surface area adjustable from an initial design heat exchange surface area to an adjusted design heat exchange surface area that is up to 300% greater than the initial design heat exchange surface area.

28. A hydrocarbon refining method, comprising:

circulating a hydrocarbon stream through a hydrocarbon stream pipeline system that extends through refining system from an inlet of the refining system;

circulating the hydrocarbon stream through a plurality of heat exchangers positioned in the hydrocarbon stream pipeline system, the plurality of heat exchangers comprising:

a first set of heat exchangers positioned in the hydrocarbon stream pipeline system in a first reaction or separation section of the refining system, the first reaction or separation section comprising a portion of the refining system between the inlet of the refining system and a second reaction or separation section of the refining system, the first set of heat exchangers comprising a first portion of heat exchangers of the first set of heat exchangers in a series arrangement of heat exchangers and a second portion of heat exchangers in the first set of heat exchangers in a parallel arrangement of heat exchangers, the first portion of heat exchangers of the first set of heat exchangers in the series arrangement of heat exchangers comprising at least three heat exchangers in series, and the second portion of heat exchangers in the first set of heat exchangers in the parallel arrangement of heat exchangers comprising at least four heat exchangers in parallel, and a second set of heat exchangers positioned in the hydrocarbon stream pipeline system in the second reaction or separation section of the refining system, the second reaction or separation section comprising a portion of the refining system after the first reaction or separation section of the refining system and before a third separation section of the refining system, the second set of heat exchangers comprising a first portion of heat exchangers of the second set of heat exchangers in a series arrangement of heat exchangers and a second portion of heat exchangers in the second set of heat exchangers in a parallel arrangement of heat exchangers;

actuating, with a control system, a first plurality of control valves to selectively thermally couple the hydrocarbon stream to a plurality of heat sources in the first reaction or separation section of the refining system within the first set of heat exchangers;

actuating, with the control system, a second plurality of control valves to selectively thermally couple the hydrocarbon stream with a plurality of heat sources in the second reaction or separation section of the refining system within the second set of heat exchangers; and heating the hydrocarbon stream through the plurality of heat exchangers.

29. A hydrocarbon refining method, comprising:

circulating a hydrocarbon stream through a hydrocarbon stream pipeline system that extends through refining system from an inlet of the refining system;

circulating the hydrocarbon stream through a plurality of heat exchangers positioned in the hydrocarbon stream pipeline system, the plurality of heat exchangers comprising:

a first set of heat exchangers positioned in the hydrocarbon stream pipeline system in a first reaction or separation section of the refining system, the first reaction or separation section comprising a portion of the refining system between the inlet of the refining system and a second reaction or separation section of the refining system, the first set of heat exchangers comprising a first portion of heat exchangers of the first set of heat exchangers in a series arrangement of heat exchangers and a second portion of heat exchangers in the first set of heat exchangers in a parallel arrangement of heat exchangers, and a second set of heat exchangers positioned in the hydrocarbon stream pipeline system in the second reaction or separation section of the refining system, the second reaction or separation section comprising a portion of the refining system after the first reaction or separation section of the refining system and before a third separation section of the refining system, the second set of heat exchangers comprising a first portion of heat exchangers of the second set of heat exchangers in a series arrangement of heat exchangers and a second portion of heat exchangers in the second set of heat exchangers in a parallel arrangement of heat exchangers, the first portion of heat exchangers of the second set of heat exchangers in the series arrangement of heat exchangers comprising at least two heat exchangers in series, and the second portion of heat exchangers in the second set of heat exchangers in the parallel arrangement of heat exchangers comprising at least six heat exchangers in parallel;

actuating, with a control system, a first plurality of control valves to selectively thermally couple the hydrocarbon stream to a plurality of heat sources in the first reaction or separation section of the refining system within the first set of heat exchangers;

actuating, with the control system, a second plurality of control valves to selectively thermally couple the hydrocarbon stream with a plurality of heat sources in the second reaction or separation section of the refining system within the second set of heat exchangers; and heating the hydrocarbon stream through the plurality of heat exchangers.

30. A hydrocarbon refining method, comprising:

circulating a hydrocarbon stream through a hydrocarbon stream pipeline system that extends through refining system from an inlet of the refining system;

circulating the hydrocarbon stream through a plurality of heat exchangers positioned in the hydrocarbon stream pipeline system, the plurality of heat exchangers comprising:

a first set of heat exchangers positioned in the hydrocarbon stream pipeline system in a first reaction or separation section of the refining system, the first reaction or separation section comprising a portion of the refining system between the inlet of the refining system and a second reaction or separation section of the refining system, the first set of heat exchangers comprising a first portion of heat exchangers of the first set of heat exchangers in a series arrangement of heat exchangers and a second portion of heat exchangers in the first set of heat exchangers in a parallel arrangement of heat exchangers, a second set of heat exchangers positioned in the hydrocarbon stream pipeline system in the second reaction or separation section of the refining system, the second reaction or separation section comprising a portion of the refining system after the first reaction or separation section of the refining system and before a third separation section of the refining system, the second set of heat exchangers comprising a first portion of heat exchangers of the second set of heat exchangers in a series arrangement of heat exchangers and a second portion of heat exchangers in the second set of heat exchangers in a parallel arrangement of heat exchangers, and a third set of heat exchangers positioned in the hydrocarbon stream pipeline system in the third separation section of the refining system, the third separation section comprising a portion of the refining system after the second reaction or separation section of the refining system and before an outlet of the refining system, the third set of heat exchangers comprising a first portion of heat exchangers of the third set of heat exchangers in a series arrangement of heat exchangers and a second portion of heat exchangers in the third set of heat exchangers in a parallel arrangement of heat exchangers;

actuating, with a control system, a first plurality of control valves to selectively thermally couple the hydrocarbon stream to a plurality of heat sources in the first reaction or separation section of the refining system within the first set of heat exchangers;

actuating, with the control system, a second plurality of control valves to selectively thermally couple the hydrocarbon stream with a plurality of heat sources in the second reaction or separation section of the refining system within the second set of heat exchangers; and heating the hydrocarbon stream through the plurality of heat exchangers.

* * * * *